US006017670A

United States Patent [19]

Hashizume et al.

[11] Patent Number: 6,017,670

[45] Date of Patent: Jan. 25, 2000

[54] ELECTROPHOTOGRAPHIC TONER AND PROCESS FOR THE PREPARATION THEREOF

[75] Inventors: Toyomi Hashizume; Shoji Okuno, both of Chiba; Yukiko Soma, Tokyo; Hitoshi Takayanagi, Chiba; Minoru Nomura, Saitama; Takashi Ito; Hiroyuki Ohminato, both of Tokyo, all of Japan

[73] Assignee: Dainippon Ink and Chemicals, Inc., Tokyo, Japan

[21] Appl. No.: 09/090,333

[22] Filed: Jun. 4, 1998

Related U.S. Application Data

[63] Continuation-in-part of application No. 09/030,891, Feb. 26, 1998, abandoned, which is a continuation-in-part of application No. 08/808,842, Feb. 28, 1997, abandoned.

[30] Foreign Application Priority Data

| | | | |
|---|---|---|---|
| Feb. 29, 1996 | [JP] | Japan | 8-042501 |
| Jun. 19, 1996 | [JP] | Japan | 8-158307 |
| Sep. 6, 1996 | [JP] | Japan | 8-236459 |
| Sep. 6, 1996 | [JP] | Japan | 8-236460 |
| Oct. 30, 1996 | [JP] | Japan | 8-238148 |
| Nov. 19, 1996 | [JP] | Japan | 8-307946 |

[51] Int. Cl.[7] ..... G03G 9/087

[52] U.S. Cl. ..... 430/109; 430/111; 430/137

[58] Field of Search ..... 430/109, 111, 430/137

[56] References Cited

U.S. PATENT DOCUMENTS

| | | | |
|---|---|---|---|
| 5,180,649 | 1/1993 | Kukimoto et al. | 430/111 |
| 5,338,638 | 8/1994 | Tsichiya et al. | 430/137 |
| 5,489,498 | 2/1996 | Ohno et al. | 430/111 |
| 5,500,318 | 3/1996 | Tanikawa et al. | 430/109 |

*Primary Examiner*—Roland Martin
*Attorney, Agent, or Firm*—Armstrong, Westerman, Hattori, McLeland & Naughton

[57] ABSTRACT

An electrophotographic toner having a volume-average particle diameter of from 3 to 15 $\mu$m. The toner comprises a spherical particulate material having an average circularity of not less than 0.97 having a colorant encapsulated in a binder resin. The binder resin is a styrene-acrylic resin having an acid value of from 30 to 150 which is at least partly crosslinked. The tetrahydrofuran insoluble content in the whole of the binder resin including crosslinkd portions in the particulate material is from 0.5 to 70% by weight.

15 Claims, No Drawings

ELECTROPHOTOGRAPHIC TONER AND PROCESS FOR THE PREPARATION THEREOF

This is a continuation-in-part application of U.S. patent application Ser. No. 09/030,891 filed Feb. 26, 1998, now abandoned, which is a continuation-in-part patent application Ser. No. 08/808,842 filed on Feb. 28, 1997, now abandoned.

FIELD OF THE INVENTION

The present invention relates to a powder toner for use in the development of an electrostatic latent image in a copying machine or printer by the electrophotographic process. More specifically, the present invention relates to a toner suitable for the process comprising fixing over a heated roll and to a process for the preparation of the toner.

BACKGROUND OF THE INVENTION

Various toners are being used as the electrophotographic toner, however, almost all are amorphous toners prepared by the so-called grinding method and a very small number of toners are spherical toners prepared by the polymerization method.

In recent years, the toner is required to satisfy various demands so as to improve the image quality or save energy of a copying machine or printer. For example, the toner is keenly required to have a small particle size for improving the image quality, however, the amorphous toner prepared by the grinding method cannot be free of conspicuous reduction in the fluidity as a result of formation into small particles. Further, the colorant comes out on the surface of a toner particle and accordingly, the control of electrostatic charge is troublesome. Furthermore, in order to reduce the demand power of a copying machine or printer, the toner must have both the capability of fixing at low temperatures and the hot-offset resistance. Almost all toners (in particular, a negatively polar toner comprising a styrene-acrylic resin as the binder) use a CCA (charge control agent), however, the CCA contains a heavy metal and may pollute the environment and therefore, it is desired, if possible, not to use the CCA.

The electrophotographic toners known up to the present time in the field of conventional techniques such as the grinding method or polymerization method have not succeeded in satisfying all these requirements.

The process for preparing a toner by the phase inversion emulsification method is a new technique of which basic technique is first disclosed in JP-A-5-66600 (the term "JP-A" as used herein means an "unexamined published Japanese patent application"). JP-A-5-66600 describes a negatively charging toner comprising an anionic self-emulsifiable binder resin having encapsulated therein a colorant and the preparation process thereof, in which the particle size distribution and the triboelectricity are mainly studied but the fixability is not specifically compared and studied. The binder resin used here is a non-crosslinked styrene-acrylic resin having a weight-average molecular weight of from 35,000 to 60,000. The styrene-acrylic resin comprises nearly 4% of the components having a molecular weight in terms of polystyrene by GPC of 200,000 or more and has a Mw/Mn ratio of about 3.

To speak roughly, the preparation process of the toner by the phase inversion emulsification method is a technique of dispersing an organic solvent solution of a resin containing a hydrophilic group and having a self-emulsifiability, a colorant and the like in an aqueous medium and forming a spherical particle having encapsulated therein a colorant.

This process is advantageous in that the particles can be easily prepared without consuming huge energy such as grinding and at the same time, small size particles can be very easily prepared. Further, particles having a sharp grain size distribution can also be prepared. Furthermore, since a surface active agent or protective colloid is not substantially used, the cleaning operation can be simple and the problem of environmental stability of the charging is relatively lightened, as compared with the process using a dispersion stabilizer such as a polymerization toner.

However, in the preparation process of the toner by the conventional phase inversion emulsification method, an organic solvent solution of resin is used and a crosslinked resin cannot be used substantially, since the crosslinked resin is not dissolved in the organic solvent. Further, even if the resin used is not crosslinked, when the resin used contains nearly 4% of the components having a molecular weight in terms of polystyrene by GPC of 200,000 or more and has a Mw/Mn ratio of about 3 as described above, hot-offset generating temperature is low and it is difficult to achieve satisfactory fixing properties.

Furthermore, the toner prepared by the phase inversion emulsification method is disadvantageous in that since the toner particle contains a polar group having hygroscopicity, the environmental stability (the degree of deflection in the triboelectricity of toner upon changing of the temperature or humidity) is insufficient and also it is considered to be ascribable to the spherical shape of the toner particle, the charge rising at the triboelectric charging is deficient and this causes a problem on practical use.

JP-A-6-258869 discloses a toner comprising as essential components a resin having a crosslinkable site, a crosslinking agent for the resin and a colorant and a process for the preparation thereof. This toner undergoes crosslinking reaction when acted upon by a heat supplied by a heating roller during heat fixing to exhibit an improved fixability. However, this approach is disadvantageous in that the crosslinking reaction proceeds gradually even during the storage of the toner. Thus, this toner lacks of storage stability. Further, the toner composition unavoidably becomes unstable when used. Thus, this toner lacks of quality stability. This toner has another great disadvantage that if the fixing speed is raised, the amount of heat required for crosslinking reaction runs short, unavoidably providing insufficient fixing.

In the present invention, a toner particle is prepared by forming a spherical particulate comprising a resin having a crosslinkable site, a crosslinking agent for the resin and a colorant as essential components, and then allowing the resin to undergo crosslinking reaction in the presence of the crosslinking agent to completion. The resulting toner can be provided with a sufficient storage stability and quality stability as well as a drastically improved heat roll fixability.

A toner comprising a crosslinked binder resin is disclosed in U.S. Pat. Nos. 5,489,498, 5,500,318, 5,338,638 and 5,180,649. However, these citations concern a toner substantially obtained by crushing process, i.e., amorphous toner having a colorant, wax, etc. exposed on the surface thereof. The present invention concerns a spherical toner comprising a styrene-acrylic resin having an acid value falling within a specific range as a binder resin, at least part thereof being crosslinked, and a colorant, wax, etc. in capsulized form. There is a big difference in basic properties of toner such as triboelectricity and powder fluidity between a spherical toner comprising a colorant, etc. in capsulized form and an amorphous toner having a colorant, etc. exposed on the surface thereof.

The ultimate object to be attained by the present invention in an optimized embodiment is to provide a toner which (1) is excellent in the heated roll fixability, (2) has good fluidity even when the particle is formed to have a small size and (3) exhibits good triboelectricity even without using a CCA, more specifically, to provide a spherical toner capable of fixing with a heated roll over a wide fixing temperature range and having excellent triboelectricity while improving the thermal fixability and the environmental stability of charging which are the problems most earnestly desired to solve in the conventional phase inversion emulsification method.

SUMMARY OF THE INVENTION

As a result of extensive investigations to obtain a toner having more excellent capabilities with respect to the above-described characteristic items required for the toner, the present inventors have found that when the toner is prepared such that the shape or form of the toner particle, the composition of the binder resin and the conditions of the external addition processing fall within a specific range, an electrophotographic toner having a wide temperature width for the heated roll fixing and excellent in the triboelectricity and fluidity can be prepared. The present invention has been accomplished based on this finding.

The present invention provides the following inventions:

1. An electrophotographic toner having a volume-average particle diameter of from 3 to 15 $\mu$m comprising a spherical particulate material having an average circularity (average of circularity defined by (perimeter of circle having the same area as projected area of grain)/(perimeter of projected image of grain)) of not less than 0.97 having a colorant encapsulated in a binder resin, wherein said binder resin is a styrene-acrylic resin having an acid value of from 30 to 150 which is at least partly crosslinked and the tetrahydrofuran insoluble content in the whole of the binder resin including crosslinked portions in said particulate material is from 0.5 to 70% by weight (hereinafter referred to as the first invention).

2. A process for the preparation of an electrophotographic toner having an average circularity of not less than 0.97 and a volume-average particle diameter of from 3 to 15 $\mu$m which comprises subjecting a mixture of a colorant, a resin which can be rendered self-emulsifiable upon neutralization and an organic solvent as essential components to phase inversion emulsification in an aqueous medium in the presence of a neutralizer in an amount large enough to render the resin self-emulsifiable to produce in said aqueous medium a particulate material comprising a colorant encapsulated in a binder resin, and then separating and drying said particulate material, characterized in that as said resin which can be rendered self-emulsifiable upon neutralization there is used an uncrosslinked styrene-acrylic resin with an acid value of from 30 to 150 containing two or more crosslinkable functional groups per molecule on the average and a crosslinking agent capable of reacting with the crosslinkable functional group in said resin is incorporated in said mixture which is then subjected to phase inversion emulsification to produce a spherical particulate material which is then subjected to crosslinking in an aqueous medium to produce a particulate material the binder resin in which is a styrene-acrylic resin having a tetrahydrofuran insoluble content of from 0.5 to 70% by weight which is at least partly crosslinked (hereinafter referred to as the second invention).

3. The process for the preparation of an electrophotographic toner as described in Clause 2, wherein both the crosslinkable functional group in said uncrosslinked styrene-acrylic resin with an acid value of from 30 to 150 containing crosslinkable functional groups and the origin of acid value are carboxyl groups and said crosslinking agent is a tertiary amine compound containing from 2 to 4 glycidyl groups having the following structural formula on the average per molecule:

(1)

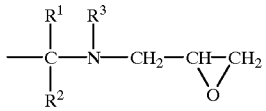

(2)

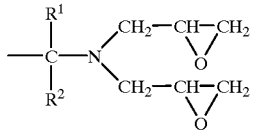

(hereinafter referred to as the third invention).

4. An electrophotographic toner comprising the spherical particulate toner obtained according to the above first invention, wherein a metal oxide fine particle subjected to surface treatment with a trifluoromethyl group-containing organic compound is externally added to the particulate toner as an essential component or both a electrically conductive fine particle and a hydrophobic silica fine particle are externally added to the particulate toner (hereinafter referred to as the fourth invention).

5. An electrophotographic toner comprising the spherical particulate toner-obtained according to the above second invention, wherein a metal oxide fine particle subjected to surface treatment with a trifluoromethyl group-containing organic compound is externally added to the particulate toner as an essential component or both a electrically conductive fine particle and a hydrophobic silica fine particle are externally added to the particulate toner (hereinafter referred to as the fifth invention).

6. An electrophotographic toner comprising the spherical particulate toner obtained according to the above third invention, wherein a metal oxide fine particle subjected to surface treatment with a trifluoromethyl group-containing organic compound is externally added to the particulate toner as an essential component or both a electrically conductive fine particle and a hydrophobic silica fine particle are externally added to the particulate toner (hereinafter referred to as the sixth invention).

DETAILED DESCRIPTION OF THE INVENTION

The first invention concerns an electrophotographic toner comprising a spherical particulate toner with a volume-average particle diameter of from 3 to 15 $\mu$m having a colorant encapsulated in a binder resin which is a styrene-acrylic resin having an acid value of from 30 to 150. The greatest feature of the present invention is that the binder resin for the particulate toner is at least partly crosslinked and the tetrahydrofuran insoluble content in the whole of the binder resin including crosslinked portions in the particulate material is from 0.5 to 70% by weight. Since the particulate toner is spherical, it provides a good fluidity even if the particle diameter is reduced. Further, since the colorant, etc. are encapsulated, the toner can exhibit almost the same triboelectricity regardless of the kind and content of the colorant used. Moreover, since the acid value of the binder resin is as high as from 30 to 150, the toner can exhibit a good triboelectricity even if CCA is not used. In addition to these effects, since the binder resin is partly crosslinked, the toner exhibits a drastically improved heated roll fixability.

The greatest feature of the second invention is that the crosslinking of the binder resin with a crosslinking agent is effected in the form of dispersion of a spherical particulate toner produced by phase inversion emulsification in a liquid medium, preferably an aqueous medium. In accordance with this invention, a spherical particulate toner free of voids with a high aerated bulk density having a partly crosslinked binder resin can be prepared by phase inversion emulsification.

The third invention contemplates the use of a specific crosslinking agent. In accordance with this invention, phase inversion emulsification can be fairly effected. Further, the crosslinking reaction after the formation of particulate material can be stably effected. As a result, a toner excellent in fixability, triboelectricity, fluidity, mechanical strength, etc. can be prepared.

The greatest feature of the fourth, fifth and sixth inventions is that as an agent to be externally added to the spherical particulate toner there is used a metal oxide fine particle subjected to surface treatment with a trifluoromethyl group-containing organic compound or a electrically conductive fine particle and a hydrophobic silica fine particle in combination. The external addition of these agents provides remarkable improvement in the environmental stability and rising of triboelectricity of the toner.

The preparation process of the present invention is characterized by the use of a specific resin, i.e., self water-dispersible resin as in the above cited JP-A-5-66600. In the present invention, the self water-dispersible resin undergoes a physicochemical phenomenon, i.e., phase inversion emulsification by which the hydrophilicity and hydrophobicity of the resin are well balanced to form particles in an aqueous medium. In other words, an organic continuous phase containing an organic solvent (O phase) and water or an aqueous medium containing water as an essential component (W phase) are mixed to cause the resin to be converted from W/O type to O/W type (so-called phase inversion emulsification) in the presence of emulsifier or dispersion stabilizer, forming a discontinuous phase and hence a particulate material.

In accordance with the foregoing process for the preparation of a particulate toner by phase inversion emulsification, a particulate toner having an extremely high sphericity can be obtained. For example, a substantially round particulate toner having a sphericity as high as not less than 0.97 as represented by average circularity can be obtained. The average circularity can be determined by calculating from the measurements on SEM (scanning electron microscope) photograph of the particulate toner. The use of Type FPIP-1000 flow process grain image analyzer produced by Toa Medical Electronics Co., Ltd. enables easy measurement. Thus, this analyzer was used in the present invention. In accordance with the present invention, a substantially round particulate toner having a Wadell's sphericity of not less than 0.8, particularly not less than 0.95, can be obtained.

The preparation process of the present invention essentially comprises the following steps:

1) A step of preparing a liquid medium dispersion of a spherical particulate material comprising a colorant encapsulated in a resin having two or more crosslinkable functional groups per molecule on the average and a crosslinking agent for the resin as a resin component;
2) A step of crosslinking a part of the resin component in the spherical particulate material dispersed in the liquid medium;
3) A step of separating and drying the partly crosslinked spherical particulate material from the liquid medium; and
4) A step of externally adding a metal oxide fine particle to the spherical particulate material.

In the present invention, the first step of preparing a liquid medium dispersion of a spherical particulate material may be embodied as follows:

(1) A method which comprises subjecting a mixture of a resin (A) which can be rendered self-emulsifiable upon neutralization, a crosslinking agent (B) for the resin (A), a colorant (C), an organic solvent (D) and a neutralizer (E) in an amount large enough to render the resin (A) self-emulsifiable in an aqueous medium to phase inversion emulsification
(2) A method which comprises dispersing an organic solvent solution comprising a resin, a crosslinking agent and a colorant in a poor solvent for the resin to prepare a particulate material
(3) A method which comprises subjecting a mixture of a radical-polymerizable monomer and a crosslinking agent having a colorant dispersed therein to suspension polymerization or emulsification polymerization in an aqueous medium
(4) A method which comprises dispersing an organic solvent solution comprising a resin, a crosslinking agent and a colorant in an aqueous medium in the presence of a surface active agent and/or protective colloid Preferred among the foregoing methods (1) to (4) are the methods (1) and (4) involving phase inversion emulsification because they can easily produce a particulate material. In particular, the method (1) is desirable in the present invention because it requires no additional provision of a washing step or, if any, only a relatively simple and short-time washing step and causes little trouble in charging stability or environmental stability. The present invention will be further described mainly with reference to the constitution of the method (1).

The resin which eventually can become a binder resin is a partly-crosslinked resin comprising a resin having two or more crosslinkable functional groups per molecule on the average and a crosslinking agent for the resin.

As the styrene-acrylic resin having two or more crosslinkable functional groups per molecule on the average there is preferably used a resin (A) containing a functional group (al) which adds to its hydrophilicity upon neutralization and two or more crosslinkable functional groups (a2) per molecule on the average.

Representative examples of the resin having two or more crosslinkable functional groups per molecule on the average include aromatic vinyl copolymer. In particular, styrene-(meth)acrylic acid ester copolymers (hereinafter referred to as "styrene-acrylic resin"), which can easily provide a toner having well-balanced powder fluidity, fixability and other properties, are desirable. In the present invention, acrylic acid ester and methacrylic acid ester are collectively referred to as "(meth)acrylic acid ester".

An example of the styrene-acrylic resin employable herein is a copolymer containing styrene as a desirable component obtained by the copolymerization of other copolymerizable monomers including (meth)acrylic acid ester. Representative examples of aromatic vinyl monomers include styrene, vinyltoluene, and α-methylstyrene.

Examples of the other copolymerizable monomers include (meth)acrylic acid esters such as methyl (meth) acrylate, ethyl (meth)acrylate, n-butyl (meth)acrylate, isobutyl (meth)acrylate, tert-butyl (meth)acrylate, isoamyl (meth) acrylate, 2-ethylhexyl (meth)acrylate, isodecyl (meth) acrylate, lauryl (meth)acrylate, stearyl (meth)acrylate, cyclohexyl (meth)acrylate, butoxymethyl (meth)acrylate, ethoxydiethylene glycol (meth)acrylate, benzyl (meth) acrylate, cetyl (meth)acrylate, tetrahydrofurfuryl (meth) acrylate and isobornyl (meth)acrylate, vinyl esters such as vinyl acetate, vinyl benzoate, vinyl versate and vinyl propionate, polymerizable nitriles such as (meth) acrylonitrile, vinyl monomers containing fluorine atom such as vinyl fluoride, vinylidene fluoride, tetrafluoroethylene, hexafluoropropylene, chlorotrifluoroethylene and (meth) acrylic acid ester having fluorine-containing alkyl group, monomers containing tertiary amino group such as diethylaminoethyl (meth)acrylate, dimethylaminoethyl (meth) acrylate, N-vinylimidazole and N-vinylcarbazole, ultraviolet-absorbing or oxidation-inhibitive monomers such as 2-(2'-hydroxy-5-methacryloyloxyethylphenyl)-2H-benzotriazole, 2-hydroxy-4-(2-methacryloyloxyethoxy) benzophenone and 1,2,2,6,6-pentamethyl-4-piperidyl methacrylate, monomers containing functional group such as N-alkoxymethyl (meth)acrylamide (e.g., N-vinylpyrrolidone, diacetone acrylamide, N-methylol acrylamide, N-butoxymethyl (meth)acrylamide), monomers containing phosphoric group such as 2-phosphoxyethyl (meth)acrylate and 4-phosphoxybutyl (meth)acrylate, and macromonomers having one polymerizable unsaturated group at the end of molecule.

Further, multi-functional radical-polymerizable monomers such as divinylbenzene and ethylene glycol di(meth) acrylate may be used in an amount such that the progress of phase inversion emulsification is not adversely affected. Needless to say, polymerizable monomers containing carboxyl group or hydroxyl group as described later may be used.

The copolymerization of the polymerizable vinyl monomers can be accomplished by any polymerization method such as suspension polymerization, emulsion polymerization, bulk polymerization and solution polymerization. Preferred among these polymerization methods is solution polymerization because it can be simply effected.

As the polymerization initiator there may be used any known peroxide or azo compound. For the purpose of adjusting the molecular weight of the polymerization system, a multi-functional polymerization initiator containing two or more peroxy groups or azo groups or a known chain transfer agent may be used.

The resin (A) to be used herein needs to contain a functional group (a1) which adds to its hydrophilicity upon neutralization and two or more crosslinkable functional groups (a2) per molecule on the average. The kind of these functional groups and the method for introducing these functional groups will be described hereinafter.

As the functional group (a1) which adds to its hydrophilicity upon neutralization, if it is an anionic group, there may be used a phosphoric group, sulfonic group or sulfuric group, particularly carboxyl group. Examples of the method for introducing a carboxylic group will be described hereinafter.

The production of the styrene-acrylic resin containing carboxyl group can be easily accomplished by a method which comprises the copolymerization of a polymerizable monomer composition containing a polymerizable monomer having a carboxyl group.

Examples of the polymerizable monomer containing a carboxyl group include acrylic acid, methacrylic acid, crotonic acid, fumaric acid, itaconic acid, maleic acid, monoalkyl maleate such as monobutyl maleate, and monoalkyl itaconate such as monobutyl itaconate.

The introduction of carboxylic group can also be accomplished by a method which comprises the addition of a monoalcohol such as butyl alcohol to a copolymer containing an acid hydride group obtained by the copolymerization of a polymerizable monomer containing an acid hydride group such as maleic anhydride or a method which comprises the addition of a compound containing an acid anhydride group such as maleic anhydride, phthalic anhydride and trimellitic anhydride to a styrene-acrylic resin containing a hydroxyl group obtained by the copolymerization of a polymerizable monomer containing a hydroxyl group.

The resin (A) needs to contain a crosslinkable functional group (a2) in addition to the functional group (a1) which adds to its hydrophilicity upon neutralization, such as carboxyl group.

The resin containing two or more crosslinkable functional groups per molecule on the average is used in combination with a crosslinking agent for crosslinking a part of the resin to produce a binder resin. These components are selected such that the crosslinkable functional group in the resin and the functional group in the crosslinking agent taking part in crosslinking undergo chemical reaction with each other to cause crosslinking.

If the resin containing two or more crosslinkable functional groups per molecule on the average is a desirable resin which can be rendered self-emulsifiable upon neutralization, containing a functional group (a1) which adds to its hydrophilicity upon neutralization and a crosslinkable functional group (a2), the crosslinkable functional group in the resin and the crosslinking agent may be used in the following combinations.

1) If the crosslinkable functional group is a carboxyl group, examples of the crosslinking agent include aminoplast resin, compound containing two or more glycidyl groups per molecule on the average, compound containing two or more 1,3-dioxolane-2-one-4-il groups per molecule on the average, compound containing two or more carbodiimide groups per molecule on the average, compound containing two or more oxazoline groups per molecule on the average, and metal chelate compound.
2) If the crosslinkable functional group is a hydroxyl group, examples of the crosslinking agent include aminoplast resin, polyisocyanate compound, and blocked polyisocyanate resin.
3) If the crosslinkable functional group is a tertiary amino group, examples of the crosslinking agent include compound containing two or more glycidyl groups per molecule on the average and compound containing two or more 1,3-dioxolane-2-one-4-il groups per molecule on the average.
4) If the crosslinkable functional group is a glycidyl group or 1,3-dioxolane-2-one-4-il group, examples of the crosslinking agent include compound containing two or more carboxyl groups per molecule on the average, polyamine compound, and polymercapto compound.

The method for introducing the crosslinkable group into the resin will be described hereinafter.

If the crosslinkable functional group is a carboxyl group, the introduction of the crosslinkable group into the resin may be accomplished by the same method as described with reference to the introduction of the functional group which adds to its hydrophilicity upon neutralization.

The production of the styrene-acrylic resin containing a hydroxyl group as a crosslinkable functional group can be easily accomplished by the copolymerization of the foregoing copolymerizable monomers in combination with a polymerizable monomer containing a hydroxyl group. Representative examples of the polymerizable monomer containing a hydroxyl group include lactone-added (meth) acrylic monomers such as 2-hydroxyethyl (meth)acrylate, 2-hydroxypropyl (meth)acrylate, 4-hydroxypropyl (meth) acrylate and Placcel FM-2 or Placcel FA-2 (available from Daicel Chemical Industries, Ltd.), polyethylene glycol mono (meth)acrylate monomers, polypropylene glycol mono (meth)acrylate monomers, hydroxyethyl vinyl ether, and hydroxybutyl vinyl ether.

The production of the styrene-acrylic resin containing a tertiary amino group as a crosslinkable functional group can be accomplished by the copolymerization of a radical polymerizable monomer containing a tertiary amino group such as dimethylaminoethyl(meth)acrylate, diethylaminoethyl (meth)acrylate and vinylpyridine, and by the addition of a secondary monoamine such as dibutylamine to the copolymers of a polymerizable monomer containing a glycidyl group such as glycidyl(meth)acrylate.

The production of the styrene-acrylic resin containing a glycidyl group as a crosslinkable functional group can be easily accomplished by the copolymerization of the copolymerizable monomers in combination with a polymerizable monomer containing a glycidyl group such as glycidyl (meth)acrylate.

The production of the styrene-acrylic resin containing a 1,3-dioxolane-2-one-4-il group as a crosslinkable functional group can be easily accomplished by the copolymerization of the copolymerizable monomers in combination with a polymerizable monomer containing a 1,3-dioxolane-2-one-4-il group. Representative examples of the polymerizable monomer containing a 1,3-dioxolane-2-one-4-il group include 1,3-dioxolane-2-one-4-ilmethyl (meth)acrylate and 1,3-dioxolane-2-one-4-ilmethyl vinylether.

The uncrosslinked styrene-acrylic resin with an acid value of from 30 to 150 containing a crosslinkable functional group employable in the present invention may comprise one resin alone or two or more resins having different weight-average molecular weights (Mw) in admixture. Alternatively, resins prepared by in-situ polymerization may be used.

The resin (A), if it is single, preferably exhibits a weight-average molecular weight Mw of from 5,000 to 200,000, more preferably from 20,000 to 150,000.

The term "molecular weight" as used hereinafter is meant to indicate molecular weight in polystyrene equivalence as determined by gel permeation chromatography (GPC).

If the resin (A) has a weight-average molecular weight of less than 5,000, it cannot provide the toner with too high an improvement in anti-hot offset properties even after the reaction for increase of molecular weight and the crosslinking reaction. On the contrary, if the resin (A) has a weight-average molecular weight of far higher than 200,000, its processability to phase inversion emulsification is disadvantageously deteriorated.

Further, the resin (A) preferably exhibits a glass transition temperature of from 40° C. to 80° C. as determined by means of a differential scanning calorimeter (DSC). The glass transition temperature of resin will be hereinafter as determined by DSC.

Resins having different weight-average molecular weights may be used in admixture as resin (A). Such a mixture of resins may be prepared such that at least one of these resins is an uncrosslinked styrene-acrylic resin with an acid value of from 30 to 150 containing a crosslinkable functional group. In a preferred embodiment, if as the resin having a higher Mw there may be used a resin containing a crosslinkable functional group, the resin having a lower Mw may be either a resin free of crosslinkable functional group or a resin containing a crosslinkable functional group.

In this case, it is preferred that the high molecular weight resin and the low molecular weight resin are so compatible with each other as to prevent the organic solvent solution used in phase inversion from becoming turbid.

The high molecular weight resin preferably has a weight-average molecular weight of from 50,000 to 200,000. If the weight-average molecular weight of the high molecular weight resin is far lower than 50,000, the resin cannot provide a sufficiently high anti-hot offset temperature even after crosslinked. On the contrary, if the weight-average molecular weight of the high molecular weight resin is higher than 200,000, the resin finds difficulty in phase inversion emulsification.

The low molecular weight resin preferably has a weight-average molecular weight of from not less than 5,000 to less than 50,000. If the weight-average molecular weight of the low molecular weight resin falls below 5,000, the resin cannot provide a sufficient enhancement in anti-hot offset temperature even after crosslinked in combination with the high molecular weight component. On the contrary, if the weight-average molecular weight of the low molecular weight resin exceeds 50,000, a sufficient low temperature fixability cannot be assured.

The weight-average molecular weight of the high molecular weight resin is preferably 10,000 higher, more preferably 20,000 higher than that of the low molecular weight resin. If the difference in weight-average molecular weight between the two resins is less than 10,000, both the requirements for low temperature fixability and anti-hot offset properties can be hardly met at the same time.

If both the functional group (a1) which adds to its hydrophilicity upon neutralization and the crosslinkable functional group (a2) in the high molecular weight resin are carboxyl groups, the content of carboxyl group is preferably such that the acid value of the resin reaches (hereinafter represented by mg of KOH required to neutralize 1 g of the solid resin content) reaches a range of from 30 to 150.

If the acid value of the resin falls below 30, the resin can undergo phase inversion emulsification in an aqueous medium less smoothly. Further, the reaction for increase of molecular weight or crosslinking reaction of the resin cannot proceed thoroughly. On the contrary, if the acid value of the resin far exceeds 150, the resulting toner disadvantageously exhibits too high a hygroscopicity.

The low molecular weight resin preferably contains a functional group (a1) which adds to its hydrophilicity upon neutralization. Further, the low molecular weight resin may contain a crosslinkable functional group (a2). If both the functional group (a1) and crosslinkable functional group (a2) are carboxyl groups, the content of carboxyl group is preferably such that the acid value of the resin reaches a range of from 30 to 150.

In order to minimize emulsification loss during phase inversion emulsification or inhibit the crosslinking reaction of the low molecular weight resin, it is preferred that the acid value of the low molecular weight resin be lowered to an extent such that the phase inversion emulsifiability thereof cannot be adversely affected.

Further, in order to preferentially cause the crosslinking of the high molecular weight resin, it is preferred that the acid value of the high molecular weight resin be as higher than that of the low molecular weight resin as 0 to 100.

The high molecular weight resin and the low molecular weight resin, if used in combination, may be mixed in a proportion such that the resulting mixture has an acid value of from 30 to 150.

The proportion of the content of the high molecular weight resin to that of the low molecular weight resin is preferably from 5/95 to 90/10, more preferably from 10/90 to 60/40 as calculated in terms of solid resin content. If the proportion of the low molecular weight resin falls below 10% by weight, the resulting toner cannot be provided with a sufficiently low fixing starting temperature. On the contrary, if the proportion of the low molecular weight resin exceeds 95% by weight, the resulting toner cannot be provided with a sufficiently high anti-hot offset temperature even after crosslinking.

The high molecular weight resin preferably exhibits a glass transition temperature of from 40° C. to 80° C.

The glass transition temperature of the low molecular weight resin may be arbitrary so far as the crosslinked particulate toner can secure a glass transition temperature of from 40° C. to 80° C., though depending on the glass transition temperature and proportion of the high molecular weight resin.

Besides the foregoing merely-blended resin obtained by mixing two or more resins having different weight-average molecular weights which have been separately synthesized, an in-situ resin may be used as well.

The foregoing in-situ resin is an uncrosslinked styrene-acrylic resin with an acid value of from 30 to 150 obtained by a process which comprises polymerizing one of two or more mixtures of addition-polymerizable monomers in a reaction vessel until the conversion thereof reaches a range of from 20% to 80%, and then adding and polymerizing the other mixture in the same reaction vessel.

If the resin to be first polymerized has a weight-average molecular weight of from 80,000 to 500,000, the resin to be subsequently polymerized may have a weight-average molecular weight of from 6,000 to 60,000. More preferably, if the resin to be first polymerized has a weight-average molecular weight of from 150,000 to 400,000, the resin to be subsequently polymerized may have a weight-average molecular weight of from 10,000 to 40,000.

The former resin and the latter resin preferably differ from each other in Tg. In some detail, the mixture of polymerizable monomers to be first polymerized and the mixture of polymerizable monomers to be subsequently polymerized are preferably prepared such that the former mixture exhibits a design glass transition temperature of from 0° C. to 60° C., the latter mixture exhibits a design glass transition temperature of from 45° C. to 80° C. and the resin produced from the two resin components exhibits a glass transition temperature Tg of from 40° C. to 80° C. as determined by DSC.

The design Tg of the polymerizable monomer is Tg determined when it is assumed that the conversion of polymerizable monomer reaches 100% and calculated by Fox's equation (see *Phys. Soc.,* 1[3], 123(1956)).

The former resin obtained from the former mixture of polymerizable monomers and the latter resin obtained from the latter mixture of polymerizable monomers containing unreacted monomers in the former mixture may possibly occur in some combinations with respect to molecular weight and glass transition temperature Tg. For example, the former resin and the latter resin may occur in such a combination that the former resin exhibits a relatively high molecular weight and a relatively low Tg while the latter resin exhibits a relatively low molecular weight and a relatively high Tg. This applies to the blended resin.

The in-situ resin can undergo phase inversion emulsification more smoothly than the blended resin. Thus, the effect of the in-situ resin is to make it possible to incorporate a component having a higher molecular weight in the system as a high molecular weight component. For example, a high molecular weight component having a molecular weight by GPC of not less than 200,000 which would be difficultly subjected to phase inversion emulsification in the blended resin can be used. As a result, the required amount of the crosslinking agent can be reduced, making it more easy to provide a good fixability (both the requirements for low temperature fixability and anti-hot offset properties at the same time) and a good triboelectricity.

As such an in-situ resin, if any, there may be used a low molecular weight resin having an acid value of from 10 to 150 and a weight-average molecular weight of from not less than 5,000 to less than 50,000 as in the case where the foregoing blended resin.

The preparation of the styrene-acrylic resin of the present invention is preferably accomplished by solution polymerization. As the solvent to be used in the solution polymerization process there may be used any organic solvent (D) to be used in the phase inversion emulsification step described later.

The foregoing resin mixture may be subjected to polymerization in such a solvent favorable for phase inversion emulsification directly followed by phase inversion emulsification or may be desolvated, and then dissolved in the solvent favorable for phase inversion emulsification to give a solution which is then subjected to phase inversion emulsification. The desolvation also makes it possible to reduce the amount of unreacted monomers or catalyst residue.

In the present invention, the polymerizing solvent can be properly selected to enhance the processability to phase inversion emulsification. The selection of the polymerizing solvent is particularly effective for the in-situ polymerization of resins comprising many components having a molecular weight by GPC of 200,000.

For example, an organic polar solvent having a solubility parameter (SP) of not less than 9 is desirable. Examples of the organic polar solvent having SP of not less than 9 include methyl ethyl ketone, ethyl acetate, acetone, butyl cellosolve, and butanol. Preferred among these organic polar solvents are the former three solvents from the standpoint of ease of desolvation. Even more desirable is a hydrous solvent obtained by adding water to the foregoing organic polar solvent in an amount of from 0.5 to 30% by weight.

If a hydrophobic organic solvent such as toluene and xylene is used in the polymerization reaction, e.g., of an acid group-containing polymerizable monomer, the resulting polymerization rate is so high that the content of acid group is nonuniform all over the resin chain molecules, occasionally giving some adverse effects on the formation of a particulate toner during phase inversion emulsification.

On the other hand, in the hydrous solvent system comprising a predetermined amount of water incorporated in an organic polar solvent, the acid group-containing polymerizable monomer is possibly dissolved in the water and reacts with the other polymerizable monomers at various reaction sites, lowering the reaction rate. Thus, the polymerization rate of the various addition-polymerizable monomers can be substantially uniform, making it easy to form a good particulate toner during phase inversion emulsification to advantage.

In the present invention, from the standpoint of ease of synthesis, handling and design of resin and ease of increase of molecular weight and crosslinking reaction, both the functional group (a1) which adds to its hydrophilicity upon neutralization and serves as an origin of acid value and the crosslinkable functional group (a2) are preferably carboxyl groups. The crosslinking agent (B) is preferably a compound containing two or more glycidyl groups per molecule on the average.

Examples of the compound containing two or more glycidyl groups per molecule on the average include glycidyl ether of phenol such as bisphenol A epoxy resin, bisphenol F epoxy resin and hydrogenated bisphenol A epoxy resin, glycidyl ether of glycol or polyol such as neopentyl glycol diglycidyl ether, glycerin diglycidyl ether, glycerin triglycidyl ether, polypropylene diglycidyl ether, trimethylol propane diglycidyl ether and sorbitol polyglycidyl ether, glycidyl ester such as adipic acid diglycidyl ester and phthalic acid diglycidyl ester, vinyl copolymer obtained by the copolymerization of polymerizable monomers having glycidyl group such as glycidyl (meth)acrylate, and epoxidized polybutadiene.

In the present invention, the reaction of the resin (A) with the crosslinking agent (B) is effected in a liquid medium, preferably an aqueous medium. Thus, the reaction is preferably effected at a temperature of lower than the boiling point of water. In order to inhibit the fusion of particles, the reaction is preferably effected at a temperature of not too higher than the glass transition temperature of the particulate material.

Preferred examples of the compound containing two or more glycidyl groups per molecule on the average suitable for the reaction under mild conditions of relatively low temperature include glycidyl amine compounds such as diglycidyl aniline, triglycidyl paraaminophenol, triglycidyl methaaminophenol and tetraglycidyl aminodiphenylmethane. Most preferred is a tertiary amine compound containing a glycidyl group represented by the following general formula (1) or (2):

(1)

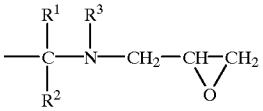

(2)

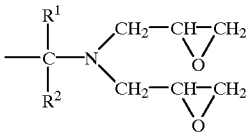

wherein $R^1$ and $R^2$ each represent a substituted or unsubstituted aromatic ring or alicyclic group, hydrogen atom or $C_{1-4}$ alkyl group; and $R^3$ represents a $C_{1-4}$ alkyl group.

Representative examples of the most preferred crosslinking agent include N,N,N',N'-tetraglycidyl-m-xylenediamine, 1,3-bis(N,N-diglycidylaminomethyl)cyclohexane, N,N-diglycidylbenzylamine, N,N-diglycidyl-α-phenylethylamine, and N,N,N',N'-tetraglycidylisophoronediamine.

The crosslinking agent preferably contains 2 to 6 glycidyl groups, more preferably 2 to 4 glycidyl groups per molecule on the average. If the number of glycidyl groups contained per molecule is less than 2, the reaction for increase of molecular weight or the crosslinking reaction cannot thoroughly proceed. On the contrary, if the number of glycidyl groups contained per molecule is greater than 6, the resulting crosslinking agent partly has a moiety having too high a crosslinking density.

If both the functional group (a1) which adds to its hydrophilicity upon neutralization and the crosslinkable functional group (a2) in the resin (A) are a carboxyl group, the amount of the carboxyl group is such that the resulting acid value falls within the range of from 10 to 150, particularly from 30 to 150.

If the resulting acid value falls below 30, particularly less than 10, the resin exhibits a deteriorated phase inversion emulsifiability in an aqueous medium and an insufficient triboelectricity and cannot sufficiently undergo polymerization reaction or crosslinking reaction. On the contrary, if the resulting acid value is far beyond 150, the resulting toner disadvantageously exhibits a high hygroscopicity.

The resin (A) preferably exhibits Tg of from 40° C. to 80° C. regardless of its kind, i.e., single resin, blended resin or in-situ resin.

The proportion of the resin containing two or more crosslinkable functional groups per molecule on the average and the crosslinking agent therefor is not specifically limited. By way of example, if the former component is a resin wherein both the functional groups (a1) and (a2) are a carboxyl group, a glycidyl group-containing compound is preferably used in an amount such that the content of glycidyl group is from 0.001 to 0.5 equivalent, more preferably from 0.002 to 0.3 equivalent, particularly from 0.01 to 0.3 equivalent per equivalent of carboxyl group.

If the content of glycidyl group falls below 0.001 equivalent, the resulting resin can insufficiently undergo the reaction for increase of molecular weight or crosslinking reaction. On the contrary, if the content of glycidyl group is too great such as more than 0.5 equivalent, the resulting resin undergoes crosslinking too far, deteriorating the fixability of the toner. The content of glycidyl group is preferably selected such that the crosslinking reaction proceeds leaving no glycidyl groups unreacted.

As the colorant (C) employable herein there may be used any dye or pigment which has heretofore been used as a toner material. Representative examples of such a dye or pigment include various pigments or oil-soluble dyes such as zinc oxide, yellow oxide, Hansa yellow, diazo yellow, quinoline yellow, permanent yellow, permanent red, red oxide, lithol red, pyrazolone red, lake red C, lake red D, brilliant carmine 6B, brilliant carmine 3B, Prussian blue, phthalocyanine blue, metal-free phthalocyanine, titanium oxide, carbon black and magnetic powder.

In the 1st step of the present invention, a mixture (occasionally referred to as "mill base") to be subjected to phase inversion emulsification, comprising the foregoing resin which can be rendered self-emulsifiable upon neutralization, a colorant and an organic solvent as essential components, and optionally a neutralizer is normally prepared. The amount of the colorant to be incorporated in the mixture may normally range from 3 to 150 parts by weight based on 100 parts by weight of the foregoing solid content of resin.

As one characteristic of the present invention by the phase inversion emulsification method, toners having high pigment concentration can be produced.

These pigments may have been previously treated with a resin or coupling agent to improve its functional characteristics. Further, an extender pigment such as calcium carbonate, barium sulfate, clay and kaolin may be used in combination with the foregoing pigment.

The material constituting the toner of the present invention has been described, and the production process of the present invention will be described below.

The process for the phase inversion emulsification of a mixture of the resin (A) which can be rendered self-emulsifiable upon neutralization, the crosslinking agent (B) for the resin (A), the colorant (C), the organic solvent (D) and the neutralizer (E) in an amount large enough to render the resin (A) self-emulsifiable in an aqueous medium, which is a desirable process in the 1st production step for the production of a liquid medium dispersion of a particulate material having a colorant encapsulated therein, will be described hereinafter.

Firstly, a solution of the resin (A) and/or crosslinking agent (B) in the organic solvent (D) and the colorant (C) are thoroughly kneaded by a known method. The mixture is then subjected to phase inversion emulsification in an aqueous medium to prepare dispersed particles. During this procedure, the colorant (C) may be added to the solution of the resin (A) and/or crosslinking agent (B) in the organic solvent (D) in the form of dispersion in a resin.

The material to be kneaded may comprise other resins or additives incorporated therein before being dispersed in the aqueous medium so that they are incorporated in particles so far as the effects of the present invention cannot be impaired. In any production steps of the present invention, auxiliaries such as wax and charge control agent may be incorporated in the system as necessary.

In the process of the present invention for the preparation of particulate toner which comprises subjecting a resin (A) which can be rendered self-emulsifiable upon neutralization to phase inversion emulsification to produce particles in an aqueous medium, a finely particulate wax which has previously been dispersed in a predetermined particle size can be subjected to phase inversion emulsification at the same time with the resin (A) and colorant (C) to obtain an encapsulated spherical particulate toner having a finely particulate wax and a colorant encapsulated therein.

Whether or not the wax is encapsulated in the particulate toner in particulate form in the spherical particulate toner obtained according to the present invention can be confirmed by a process which comprises embedding the particulate toner in a resin, cutting the embedded toner by a microtome, dyeing the section of the specimen with ruthenium oxide or the like, and then observing the section thus dyed under TEM (transmission electron microscope). This process can apply to the case where a colorant other than wax is encapsulated.

The wax may be incorporated in the mixture to be subjected to phase inversion emulsification in the form of solid particulate material or particulate dispersion in an aqueous or nonaqueous medium. As the wax there may be preferably used one insoluble in the organic solvent in the mixture to be subjected to phase inversion emulsification.

As the wax employable herein there may be preferably used a compound having a relatively low softening point or melting point. Examples of the wax employable herein include waxes having a softening point (melting point) of from 40 to 130° C. such as petroleum wax of higher hydrocarbon (e.g., paraffin wax, microcrystalline wax), vegetable wax of higher ester (e.g., carnauba wax, candelilla wax, Japan wax, rice wax) and synthetic wax of higher hydrocarbon (e.g., polypropylene wax, polyethylene wax, Fischer-Tropsch wax). Waxes having different softening points (melting points) may be used in admixture.

The dispersion of the particulate wax in the resin which can be rendered self-emulsifiable upon neutralization can be accomplished by knead-dispersing the material during melt-kneading process as in the crushing method or by wet-dispersing the material. In the preparation process of the present invention, the wet-dispersion is desirable because it is simple in the process. The melt-kneading process is disadvantageous in that the particulate wax which has been dispersed in a desired particle diameter can be further finely dispersed or occasionally re-agglomerated.

In the wet-kneading process, either the simultaneous dispersion of a resin, a colorant, a particulate wax or its dispersion in a liquid medium or the dispersion of a resin and a colorant, followed by the dispersion of a particulate wax or its dispersion in a liquid medium, may be employed. The latter method is preferred to the former because it has less adverse effect on the granulating properties during phase inversion emulsification. In the former process, highly hydrophobic components such as wax are adsorbed by the colorant, possibly giving some adverse effects on the formation of particles during phase inversion emulsification.

In accordance with the preparation process of the present invention, a liquid medium dispersion of a particulate wax comprising the foregoing wax dispersed in a liquid medium in a predetermined particle diameter and particularly a water dispersion may be preferably used.

The softening point (melting point) of the wax to be used in the present invention may be from 40° C. to 130° C., preferably from 60° C. to 120° C. If the softening point of the wax falls below 40° C., the resulting toner leaves something to be desired in blocking resistance or storage stability. On the contrary, if the softening point of the wax exceeds 130° C., the resulting toner disadvantageously exhibits too high a fixing starting temperature.

The amount of the wax to be added is from 1% to 30% by weight, preferably from 2% to 20% by weight, as calculated in terms of solid content based on the solid content of the resin which can be rendered self-emulsifiable upon neutralization. If the amount of the wax falls below 1% by weight, the effect of the wax cannot be sufficiently exerted. On the contrary, if the amount of the wax exceeds 30% by weight, the resin disadvantageously cannot have the wax sufficiently encapsulated therein, deteriorating the developability of the toner.

The particle diameter of the particulate wax to be added is preferably predetermined smaller than that of the particulate toner to be obtained. It is normally from 0.1 to 3 $\mu$m, preferably from 0.2 to 2 $\mu$m. If the particle diameter of the particulate wax falls below 0.1 $\mu$m. the particulate wax melts and comes out on the surface of the particulate toner during melting, making it impossible to exert a sufficient releasing effect, even if the content of the wax is raised. On the contrary, if the particle diameter of the particulate wax exceeds 3 $\mu$m, the content of the wax in the particulate toner is nonuniform or the wax is exposed on the surface of the particulate toner, deteriorating the developability of the toner.

The preparation process of the present invention involving the use of a mixture containing a particulate wax for phase inversion emulsification has the following characteristics:

1) The dispersion of a particulate wax which has previously been controlled to have a desired particle diameter in a resin solution which does not dissolve and swell the particulate wax makes it easy to control the particle diameter of the particulate wax. Needless to say, the dispersed particle diameter of the particulate wax has a great effect on the releasing effect during fixing. In the melt-kneading process in the crushing method, the releasing effect during fixing is restricted by the kind or softening point (melting point) of the wax used, making it difficult to prepare the desired particulate toner. In particular, the encapsulation of the particulate wax in the particulate toner makes it possible to use a wax having a relatively low softening point (melting point) which would be difficult to prepare in the crushing method or polymerization method.

2) In accordance with the phase inversion emulsification method, the dispersion of the colorant or wax in the organic phase (mixture to be subjected to phase inversion emulsification) can be kept even after the formation of the particulate toner after phase inversion. Accordingly, there causes neither agglomeration of colorant or wax nor nonuniform encapsulation of these components.

3) In accordance with the phase inversion emulsification method, the hydrophilicity and hydrophobicity of the resin are properly balanced to produce particles. Accordingly, hydrophobic components such as colorant and wax can be encapsulated in the particulate toner. The resulting toner is little liable to deterioration of developability due to wax.

Examples of the organic solvent (D) employable herein include various hydrocarbons such as toluene, xylene, benzene, n-hexane, cyclohexane and n-heptane, alcohols such as methanol, isopropanol, n-propanol, ethanol, n-butanol, isobutanol, sec-butanol and t-butanol, ether alcohols such as propylene glycol monomethyl ether, propylene glycol monoethyl ether, propylene glycol monoisopropyl ether, propylene glycol mono-n-butyl ether, ethylene glycol monomethyl ether, ethylene glycol monoethyl ether, ethylene glycol monoisopropyl ether and ethylene glycol mono-n-butyl ether, various ketones such as acetone, methyl ethyl ketone and methyl isobutyl ketone, various esters such as butyl acetate, ethyl acetate and isopropyl acetate, various ether esters such as propylene glycol monoethyl ether acetate and ethylene glycol monoethyl ether acetate, ethers such as tetrahydrofuran, and halogenated hydrocarbons such as methylene chloride.

Preferred among these organic solvents is a so-called low boiling solvent which can be easily desolvated at the step described later, such as acetone, methyl ethyl ketone, ethyl acetate, isopropanol and n-propanol. Needless to say, two or more of these solvents may be used in combination.

The solvent to be used in the synthesis and dissolution of the resin (A) may differ from the solvent (D) to be used in the phase inversion emulsification in an aqueous medium. For the simplification of the procedure, the two solvents are preferably the same.

In order to effect the phase inversion emulsification of the resin in the aqueous medium, a method is preferably employed which comprises providing the resin (A) with a hydrophilic group to form a salt structure, and then dispersing the resin in an aqueous medium. In particular, a method which comprises neutralizing with a basic compound a resin containing a carboxyl group as a functional group which adds to its hydrophilicity upon neutralization to provide the resin with a hydrophilicity such that it can be stably dispersed in an aqueous medium is desirable because it causes little troubles in charging stability or environmental stability and requires no separate washing step or, if any, a relatively simple and short-time washing step.

If as the resin containing two or more crosslinkable functional groups per molecule on the average there is used a resin containing only two or more crosslinkable functional groups (a2) per molecule on the average which is not rendered water-dispersible regardless of whether or not neutralized, an emulsifier or a dispersion stabilizer such as protective colloid is required as an essential component that requires, e.g., a separate washing step.

The dispersion in an aqueous medium of a mixture of a carboxyl-containing resin which can be water-dispersible upon neutralization, both the functional group (a1) which adds to its hydrophilicity upon neutralization and the two or more crosslinkable functional groups (a2) to be contained per molecule on the average in which resin are carboxyl groups, as an example of the resin (A), the crosslinking agent (B), the colorant (C) and the organic solvent (D) by phase inversion emulsification can be properly accomplished by any of the following methods:

1) A method which comprises adding the neutralizer (E) to the mixture, and then dispersing the mixture in an aqueous medium;

2) A method which comprises adding the neutralizer (E) to the mixture, and then adding an aqueous medium to the mixture;

3) A method which comprises dispersing the mixture in an aqueous medium containing the neutralizer; and 4) A method which comprises adding an aqueous medium containing the neutralizer (E) to the mixture.

The resin containing a functional group (a1) which adds to its hydrophilicity upon neutralization is neutralized with the neutralizer (E) having a polarity opposite to that of the foregoing functional group (a1) in a required amount to form a salt structure which can produce a resin that can be dispersed in an aqueous medium even in the absence of emulsifier or dispersion stabilizer (This resin is a self-emulsifiable resin).

Preferred among the foregoing methods (1) to (4) is the method (2) because the eventually obtained partly-crosslinked particulate material comprising a colorant encapsulated therein has a narrower particle diameter distribution.

As the neutralizer (E) to be used in the formation of the salt structure there may be used a basic compound if the functional group (a1) in the resin (A) which adds to its hydrophilicity upon neutralization is an acid group. Examples of the basic compound employable herein include volatile amines such as ammonia, triethylamine, tributylamine and dimethyl ethanolamine, and inorganic bases such as sodium hydroxide and potassium hydroxide. As such a basic compound there may be preferably used a non-crosslinking compound from the standpoint of phase inversion emulsification properties or crosslinking time. Examples of the acidic compound to be used to convert the acid group which has been neutralized with a neutralizer described later back to a free acid group include organic acids such as formic acid, acetic acid and toluenesulfonic acid, and inorganic acids such as hydrochloric acid, sulfuric acid and phosphoric acid.

During the phase inversion emulsification in an aqueous medium, a surface active agent or a dispersant such as protective colloid may be used so far as the toner properties or the subsequent steps cannot be adversely affected.

The agitating shear to be used in the phase inversion emulsification in an aqueous medium doesn't need to be given any special consideration so far as the mixture can be sheared so properly that it is rendered homogeneous. In some cases, a high shearing dispersion as realized by a homogenizer or ultrasonic wave may be used.

The term "aqueous medium" as used herein is meant to indicate a material comprising water as a main component and optionally a water-soluble solvent, a dispersion stabilizer, a neutralizer and other additives incorporated therein.

The particle diameter which is an important in the production of the toner, if a carboxyl group is used as the functional group (a1), can be controlled mainly by adjusting the amount of a base used to neutralize the carboxyl group. In some detail, by varying the amount of neutralization by the base within a range of from 5 to 100 mol-% of the carboxyl group, a particulate material having a particle diameter ranging from submicron (less than 1 μm) to about 30 μm can be easily and arbitrarily obtained.

The ease of control over the particle diameter is one of the characteristics of the phase inversion emulsification method for the preparation of toners. Accordingly, particulate materials having a particle diameter on the order of 6 to 7 μm or about 5 μm which have been recently expected to provide a high resolution toner or having a particle diameter which will be required in the future can be readily realized.

The liquid medium dispersion of particulate material thus obtained then undergoes crosslinking reaction as the 2nd step of the present invention. The crosslinking reaction of the present invention occurs in the particulate material thus produced. This reaction occurs between the resin containing two or more crosslinkable functional groups per molecule on the average homogeneously dispersed unreacted in the particle and the crosslinking agent regardless of the form of the resin, i.e., single resin, blended resin or in-situ resin.

The liquid medium is preferably an aqueous medium because the crosslinking reaction can occur mildly. If the liquid medium for dispersing a particulate material therein is an aqueous medium and the resin containing two or more crosslinkable functional groups per molecule on the average has a salt structure obtained by the neutralization of the functional group (a1) with a neutralizer, the part taking part in the crosslinking is substantially only the functional group (a2). The crosslinking reaction under these conditions makes it possible to assure the dispersion stability of the dispersion of particulate material.

The crosslinking reaction is preferably effected at a temperature of not higher than the boiling point of the aqueous medium. Further, the crosslinking reaction is preferably effected at a temperature of not too higher than the glass transition temperature of the particulate material to inhibit the fusion of particles. Thus, the reaction temperature may generally range from 40° C. to 100° C., preferably from 50° C. to 90° C. The crosslinking time may be arbitrary so far as it is long enough to complete the crosslinking reaction. It may range from 30 minutes to 24 hours, preferably from 1 to 10 hours. In some detail, the dispersion of particulate material may be kept at a predetermined temperature for the period of time required to complete the crosslinking reaction.

In order to effect the reaction, under relatively low temperature mild conditions, of a carboxyl group with a glycidyl group as in the case where a resin containing two or more crosslinkable functional groups (a2) per molecule on the average is used as the resin (A) and a compound containing two or more glycidyl groups per molecule on the average is used as the crosslinking agent (B) for resin (A), the glycidylamine compound as described above is preferably used. If such a glycidylamine compound or other glycidyl-containing compounds are used, a known catalyst such as 2-methylimidazole may be used. Alternatively, a secondary monoamine such as dibutylamine may be added to some glycidyl groups in these glycidyl-containing compounds to provide these glycidyl-containing compounds with self-catalyzing properties.

The crosslinking reaction may be effected at any stage between after the preparation of the aqueous medium dispersion of a particulate material and before the step of separating and drying the particulate material from the aqueous medium in all the steps involving the preparation of the aqueous medium dispersion of the particulate material, optionally followed by various after-treatments, and the subsequent separation and drying of the particulate material from the aqueous medium. In order to inhibit the fusion of particles, it is preferably effected after the desolvation of the system.

A preferred process for the preparation of a particulate toner of the present invention comprises preparing an aqueous medium dispersion of a particulate material having a colorant (C) dispersed therein from, as resin components, a resin containing two or more crosslinkable functional groups per molecule on the average obtained by the phase inversion emulsification in an aqueous medium of a mixture of the resin (A) containing a functional group (a1) which adds to its hydrophilicity upon neutralization and two or more crosslinkable functional groups (a2) per molecule on the average, which resin can be rendered self-emulsifiable upon neutralization, the crosslinking agent (B) for the resin (A), the colorant (C), the organic solvent (D) and the neutralizer (E) in an amount large enough to render the resin (A) self-emulsifiable and a crosslinking agent for the resin, crosslinking a part of the resin to produce a binder resin, and then separating and drying the partly-crosslinked particulate material thus obtained from the aqueous medium.

In the foregoing preparation process, it is preferred that both the functional group (a1) which adds to its hydrophilicity upon neutralization and the two or more crosslinkable functional groups (a2) to be contained per molecule on the average in the resin (A) are carboxyl groups and the crosslinking agent (B) for the resin (A) is a compound containing two or more glycidyl groups per molecule on the average. Further, it is most preferred that the glycidyl group containing two or more glycidyl groups per molecule on the average is a glycidylamine, particularly a glycidylamine containing two to four glycidyl groups per molecule on the average represented by the following general formula (1) or (2):

(1)

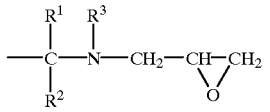

(2)

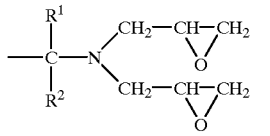

wherein $R^1$ and $R^2$ each represent a substituted or unsubstituted aromatic ring or alicyclic group, hydrogen atom or $C_{1-4}$ alkyl group; and $R^3$ represents a $C_{1-4}$ alkyl group.

The after-treatment process to be optionally effected before or after the foregoing crosslinking step involves a step of desolvating by distillation under reduced pressure, a step of removing impurities or coarse particles by filtration or rinsing, and a step of back-neutralizing a functional group (a1) which can be rendered hydrophilic upon neutralization and has been neutralized with a neutralizer (E) having a polarity opposite to that of the functional group to for a salt structure with a compound having the same polarity as that of the functional group (e.g., step of acid-treating a carboxyl group which has been neutralized with a base back to convert it back to the carboxyl group).

Among these steps, the step of back-neutralizing is preferably effected to improve the moisture resistance of the toner and hence the charging stability or environmental stability thereof. This step may be accomplished by adding a compound having the same polarity as that of the functional group (a1) to the aqueous medium dispersion of a particulate self-emulsifiable resin having a colorant encapsulated therein. The resulting salt can be easily removed by rinsing.

In the foregoing step, if the functional group (a1) is a carboxyl group, an acidic compound such as hydrochloric acid, sulfuric acid and phosphoric acid may be added to the functional group which has been neutralized with a basic compound to form a salt structure to convert the functional group back to the original carboxyl group.

The crosslinking step, optionally followed by after-treatment step, is followed by the final step of separating and drying the particulate material from the aqueous medium to obtain a spherical particulate toner. The drying of the particulate material may be accomplished by any known method such as hot-air drying, spray drying and freeze-drying.

As the resin for binding the particulate material crosslinked according to the present invention there may be used a resin having an insoluble content of not less than 0.1% by weight as determined after 24 hours of Soxhlet extraction with tetrahydrofuran (hereinafter insoluble content in resin component alone) and/or a tetrahydrofuran-soluble content having a molecular weight at least higher than the weight-average molecular weight of the resin containing two or more crosslinkable functional groups per molecule on the average which has been crosslinked with a crosslinking agent.

The spherical particulate toner thus obtained preferably exhibits a glass transition temperature of from 40° C. to 80° C. The insoluble content in the entire binder resin containing a crosslinked moiety is preferably from 0.5 to 70% by weight as determined by Soxhlet extraction with tetrahydrofuran regardless of the form of the resin, i.e., single resin, blended resin or in-situ resin.

Further, the tetrahydrofuran-soluble content needs to have a weight-average molecular weight of at least higher than the weight-average molecular weight of the foregoing resin containing two or more crosslinkable functional groups per molecule on the average.

In particular, it is more preferable that the molecular weight of the binder resin shows a peak in the range of from 5,000 to 200,000 and at least one peak or shoulder in a range of not less than 200,000, particularly not less than 500,000.

Most preferably, the binder resin in the particulate toner obtained by the phase inversion emulsification and crosslinking of a resin containing two or more crosslinkable functional groups per molecule on the average having a carboxyl acid value of from 30 to 150, a weight-average molecular weight of from 5,400 to 200,000 and a glass transition temperature of from 40° C. to 80° C., has a carboxyl acid value of from 30 to 150, a glass transition temperature of from 40° C. to 80° C., and a tetrahydrofuran insoluble content of 0.5 to 70% by weight, and the molecular weight of the resin shows a peak in the range of from 5,000 to 200,000 and at least one peak or shoulder in a range of not less than 200,000, particularly not less than 500,000, in GPC of tetrahydrofuran soluble content.

The binder resin contained in the toner of the present invention is one obtained by crosslinking a styrene-acrylic resin having an acid value of from 30 to 150. If the resin which can be rendered self-emulsifiable upon neutralization differs in the origin of acid value from the foregoing crosslinkable functional group which can react with a crosslinking agent, the acid value of the binder resin in the eventually obtained toner depends on the percent neutralization of the acid group in the resin which can be rendered self-emulsifiable upon neutralization with a neutralizer.

On the other hand, if the resin which can be rendered self-emulsifiable upon neutralization is the same as the foregoing crosslinkable functional group which can react with a crosslinking agent in the origin of acid value, the acid value of the binder resin in the eventually obtained toner depends on the reaction proportion of the crosslinking agent to the crosslinkable functional group in the resin and the percent neutralization of the acid group in the resin which can be rendered self-emulsifiable upon neutralization with a neutralizer. However, since some of the acid value is consumed by the crosslinking reaction, the acid value is reduced by the factor of the acid group which has contributed to the crosslinking reaction.

Anyway, in order to accurately determine the content of the acid group in the binder resin which has not contributed to the crosslinking reaction, all the acid groups may be converted to free acid groups in accordance with the foregoing procedure before the measurement of acid value.

The thus-obtained powder toner particle can be used by itself as an electrophotographic toner, however, in general, it is preferably used as an electrophotographic toner after the external addition of a metal oxide fine particle.

The spherical toner comprising a binder resin having encapsulated therein a colorant formed by the phase inversion emulsification has fairly different triboelectricity from the amorphous toner formed by the grinding method. More specifically, in the case of a toner by the grinding method, a colorant, a charge control agent or a wax partly comes out on the surface of a particle and this greatly affect the triboelectricity of the toner. Accordingly, the toner formed by the grinding method exhibits quite different behavior from the toner having encapsulated therein a colorant or the like as the objective of the present invention even though raw materials such as a binder resin and a colorant are the same.

In the spherical toner as the objective of the present invention, due to the presence of a hygroscopic polar group on the surface of a particle, the toner cannot have a satisfactory environmental stability (degree of stability in the charge amount against change of the temperature or humidity) and the charge amount is greatly reduced particularly at a high humidity, which gives rise to a trouble in practice.

Further, the toner as the objective of the present invention is spherical and accordingly, the triboelectric charging with a carrier or the like is generated by the point contact and the efficiency is duly assumed to be low as compared with the case of an amorphous toner formed by the grinding method or the like where the triboelectric charging is generated by the plane contact. This is considered to be responsible for the fact that the charge rising is slow (a long time is necessary for reaching the saturated charge amount) and the charge amount distribution at the rising is deficient in the uniformity.

In the fourth, fifth and sixth inventions of the present invention, external addition as described below is applied and the above-described problems can be overcome.

By externally adding a metal oxide fine particle subjected to surface treatment with an organic compound having a trifluoromethyl group to the surface of a spherical toner particle of the present invention, the environmental stability of charging is outstandingly improved and when the toner is used as an electrophotographic negatively polar toner in a copying machine or printer, a good image can be obtained.

The metal oxide fine particle indicates a fine particle of a metal oxide such as titanium oxide, aluminum oxide, silicon oxide, zinc oxide, tin oxide, antimony oxide or magnesium oxide, having an average particle size of about 1 $\mu$m or less, preferably approximately from 5 to 100 nm. Among these metal oxide fine particles, a fine particle of titanium oxide is practically suitable because the fine particle itself has almost neutral triboelectricity and cheap fine particles having an average particle size of from 5 to 100 nm can be easily available.

The term "Torganic compound having a trifluoromethyl group" as used in the present invention means an organic compound (including a polymer) having at least —$CF_3$ group in the molecular structure and a perfluoroalkyl acrylate resin or an alkoxysilane, alkylsilane or chlorosilane compound having a perfluoroalkyl group is preferably used. Specific examples thereof are set forth below.

Dicguard NH-15 (toluene dispersion of $CF_3$—$(CF_2)_7$— containing acrylate resin available from Dainippon Ink & Chemicals, Inc.)

$CF_3$—$(CH_2)_9$—$Si(OCH_3)_3$ $CF_3$—$(CH_2)_2$—$Si(OCH_3)_3$ $CF_3$—$(CF_2)_7$—$(CH_2)_2$—$Si(OCH_3)_3$ $CF_3$—$(CF_2)_7$—$(CH_2)_2$—$Si(CH_3)(OCH_3)_2$ $CF_3$—$(CF_2)_7$—$(CH_2)_2$—$Si(CH_3)_3$ $CF_3$—$(CF_2)_7$—$(CH_2)_2$—$SiCl_3$ $CF_3$—$(CF_2)_7$—$SO_2NH(CH_2)_3NH_2$

The surface treatment of a metal oxide fine particle with the organic compound having a trifluoromethyl group may be performed by a method such that the organic compound is dissolved in a toluene- or alcohol-base organic solvent and thoroughly mixed with a metal oxide fine particle and after removing the organic solvent by distillation or the like, the mixture is heat-treated and crushed.

The amount of the organic compound having a trifluoromethyl group for use in the surface treatment of a metal oxide fine particle is suitable from 5 to 30% by weight based on the metal oxide fine particle. So far as the amount externally added is the same, as the amount of the organic compound used in the surface treatment of the metal oxide fine particle is larger, the toner charge amount is liable to increase and therefore, the amount of the organic compound used in the surface treatment is preferably controlled according to the use purpose.

The organic compound having a trifluoromethyl group exhibits strong water repellency because the surface energy of the trifluoromethyl group is extremely low and at the same time, because of the property such that the compound becomes highly negative on the friction, an effect of considerably increasing the negative charging of the toner is exerted. As a result, the toner having externally added thereto a metal oxide fine particle surface-treated with an organic compound having a trifluoromethyl group is greatly improved in the environmental stability and also outstandingly improved in the charge rising property (the rate for reaching the saturated charge amount).

In externally adding a metal oxide fine particle surface-treated with an organic compound having a trifluoromethyl group to the surface of a spherical toner particle comprising a binder resin having encapsulated therein a colorant, a silica fine particle may be externally added in combination, if desired.

The silica fine particle is preferably silica having an average primary particle size of from 5 to 100 nm, particularly from 5 to 50 nm and having hydrophobicity. A large number of such silica fine particles are commercially available as described later and it may be convenient to use these in practice.

By externally adding an electrically conductive fine particle and a hydrophobic silica fine particle to the surface of the spherical toner particle according to the present invention, the charge rising and the uniformity of charging can be greatly improved.

The electrically conductive fine particle for use in the present invention is not particularly limited as long as the fine particle has electric conductivity and examples thereof include a titanium oxide fine particle surface-treated with tin oxide-antimony, a stannic oxide fine particle doped with antimony and a stannic oxide fine particle. The electrically conductive fine particle preferably has an average primary particle size of about 1 $\mu$m or less, more preferably from 1 to 800 nm, still more preferably from 5 to 500 nm.

Examples of the commercially available electrically conductive titanium oxide fine particle treated with tin oxide-antimony include EC-300 (produced by Titan Kogyo K.K.), ET-300, HJ-1, JI-2 (all produced by Ishihara Sangyo Kaisha, Ltd.) and W-P (produced by Mitsubishi Materials Corporation).

Examples of the commercially available electrically conductive tin oxide doped with antimony include T-1 (produced by Mitsubishi Materials Corporation) and SN-1OOP (produced by Ishihara Sangyo Kaisha, Ltd.). Examples of the commercially available stannic oxide include SH-S (produced by Nihon Kagaku Sangyo Co., Ltd.).

In the present invention, an electrically conductive fine particle is used and in particular, an electrically conductive fine particle having hydrophobicity is suitably used. The term "hydrophobicity" as used herein can be evaluated by the methanol hydrophobicization degree (the % by volume of methanol necessary for completely wetting the powders floating on the water surface). An electrically conductive fine particle having the value of about 20% or more is used. Such an electrically conductive fine particle can be obtained through hydrophobicization which is preferably performed by such a method that the above-described electrically conductive fine particle such as a titanium oxide fine particle surface-treated with tin oxide-antimony, a stannic oxide fine particle doped with antimony or a stannic oxide fine particle, is added to a hydrophobicizer solution while stirring and after homogeneously mixing it, the mixture is heated and crushed or the above-described electrically fine particle is mixed with a hydrophobicizer and an organic solvent/water to present a homogenous dispersion state and after removing the organic solvent by distillation or the like, the mixture is heated and crushed.

The hydrophobicizer is not particularly limited and any material may be used as long as the material itself or a reaction product or hydrolysate thereof exhibits hydrophobicity. Preferred examples thereof include various organic silicon compounds, titanate-base coupling agents, aluminum-base coupling agents, fluorine-base organic compounds and fluororesins such as fluoro(meth)acrylate (co) polymer.

Examples of the organic silicon compound include various silicone oils and silane coupling agents such as organochlorosilane (e.g., trichloromethylsilane, dichlorodimethylsilane, chlorotrimethylsilane, trichloroethylsilane, dichlorodiethylsilane, chlorotriethylsilane, chlorotriphenylsilane), organosilazane (e.g., triethylsilazane, triphenylsilazane, hexaethyldisilazane, hexamethyldisilazane) and organoalkoxysilane (e.g., dimethoxydimethylsilane, trimethoxymethylsilane).

Examples of the titanate-base coupling agents include isopropyltriisostearoyl titanate and isopropyltris (dioctylpyrophoshate) titanate. Examples of the aluminum-base coupling agent include acetoalkoxyaluminum diisopropylate.

The fluorine-containing organic compound is an organic compound (including polymers) containing at least —$CF_3$ group in the molecule structure and perfluoroalkyl acrylate resin or perfluoroalkyl-containing alkoxysilane, alkylsilane or chlorosilane compound may be suitably used. Specific examples thereof are described above.

The hydrophobic silica fine particle for use in the present invention is not particularly limited as long as the silica has an average primary particle size of approximately from 5 to 100 nm, preferably subjected to the surface treatment for hydrophobicization and having a methanol hydrophobicization degree of about 20% or more. The hydrophobicization may be performed by a generally known method as used for the above-described electrically conductive fine particle, however, it is convenient to use commercially available hydrophobic silica fine particles.

Examples of the commercially available hydrophobic silica fine particle which can be suitably used in the present invention include HDK, H2000, HDKH1303 (all produced by Wacker Chemicals East Asia Co., Ltd.), SLM 50650 (produced by Hoechst Japan Limited), R972, R976, RX200, RX170, NAX50 and RY200 (all produced by Nippon Aerosil Co., Ltd.).

The electrically conductive fine particle and the silica fine particle each is added in an amount of from 0.05 to 3% by weight based on the spherical colored resin particle. The weight ratio of the electrically conductive fine particle to the silica fine particle is not particularly limited but it is usually from 80/20 to 20/80, preferably from 70/30 to 30/70.

The reason why the spherical toner of the present invention is improved in the charge rising property by externally adding an electrically conductive fine particle and a hydrophobic silica fine particle is not clarified, however, the present inventors presume it as follows.

The spherical toner comprising a binder resin having encapsulated therein a colorant has high insulating effect on the surface thereof and therefore, the charge generated by the friction is difficult to smoothly transfer/exchange to the toner particle present in the vicinity thereof. When a certain degree of electrical conductivity is imparted to the surface of a toner particle, the charge amount itself is reduced, however, movement-exchange of a charge among toner particles in the vicinity proceeds at an increased rate, as a result, the time required for reaching the saturation charge amount is shortened and the uniformity of the charge amount distribution is elevated.

However, since the electrically conductive fine particle such as titanium oxide and tin oxide is hydrophilic, satisfactory environmental stability as the toner cannot be necessarily achieved by the external addition of the electrically conductive fine particle, but when the surface of the electrically conductive fine particle is subjected to hydrophobicization, good charge rising property and good environmental stability can be attained.

The external addition is not particularly limited but may be performed by a commonly known method using a Henschel mixer or Hybridizer. When two or more kinds of external additives are used, these may be externally added in parts through two or several stages or may be mixed and externally added batchwise.

By the external addition as in the fourth, fifth and sixth inventions, a good triboelectricity can be obtained regardless of the use of CCA, but the present invention does not exclude the use of CCA.

With respect to the particle size of the electrophotographic toner of the present invention, any size can be selected within the volume-average particle size is approximately from 3 to 30 $\mu$m. However, in view of matching with currently used machines, those having a volume-average particle size of from 3 to 15 $\mu$m, particularly from 6 to 15 $\mu$m are preferred.

The toner of the present invention preferably has a bulk density (g/cm$^3$) of 0.25 or more. By externally adding an external additive such as a metal oxide fine particle (e.g., silica) to the toner primary body comprising a spherical particle, the powder after the external addition has a bulk density larger than that before the external addition. In the present invention, this bulk density has the same meaning as the aerated bulk density. A larger aerated bulk density is generally preferred, however, in the present invention, the aerated bulk density is preferably 0.35 g/cm$^3$ or more, more preferably 0.4 g/cm$^3$ or more. Typically, the toner is preferably formed to have an aerated bulk density of 0.35 g/cm$^3$ or more, more preferably 0.4 g/cr$^3$ or more, by externally adding an external additive such as a metal oxide fine particle (e.g., silica) to a primary body toner particle having an aerated bulk density of from 0.25 to less than 0.35 g/cm$^3$. That the aerated bulk density is large means that the toner has excellent powder fluidity and the spherical toner particle has no or a very small amount of void, which corresponds to the fact that the toner particle has a more excellent mechanical strength against the external stress. For preparing a toner particle having a large aerated bulk density, the above-described phase inversion emulsification method using an in-situ resin is suitable.

The thus-obtained powder toner can be used as a non-magnetic one-component developer for the development of an electrostatic image or after combining with a carrier, as a two-component developer. When the powder toner obtained mainly contains magnetic powder as a colorant, it may be used as a magnetic one-component developer.

As the carrier there may be used any known conventional carrier. Examples of the carrier employable herein include powder of metal such as iron, nickel, copper, zinc, cobalt, manganese, chromium and rare earth metal, alloy or oxide thereof and surface-treated glass and silica. Needless to say, a resin-coated carrier such as acrylic resin-coated carrier, fluororesin-coated carrier and silicone resin-coated carrier may be used. The carrier employable herein may have an average particle size of from about 20 to 200 $\mu$m, particularly from about 30 to 200 $\mu$m.

In order to obtain a two-component developer from the toner obtained in the present invention and the foregoing carrier, the toner may be used in a mixing proportion of from 1 to 15 parts by weight based on 100 parts by weight of the carrier used.

Practical Embodiment of the Present Invention

The present invention is implemented as follows:

1. An electrophotographic toner comprising a particulate material having a colorant encapsulated in a binder resin, wherein said binder resin is a styrene-acrylic resin having an acid value of from 30 to 150 mg (KOH)/g which is at least partly crosslinked, the tetraydrofuran (THF) insoluble content in the whole of the binder resin including crosslinked portions in said particulate material is from 0.5 to 70% by weight, and said particulate material has a Wadell's practical sphericity of not less than 0.8 and a volume-average particle diameter of from 3 to 15 μm.

2. The electrophotographic toner as described in Clause 1, which has a bulk density of not less than 0.25 $cm^3/g$.

3. The electrophotographic toner as described in Clause 1 or 2, wherein said particulate material comprises a particulate wax encapsulated in a binder resin together with a colorant.

4. A process for the preparation of an electrophotographic toner having a Wadell's practical sphericity of not less than 0.8 and a volume-average particle diameter of from 3 to 15 μm which comprises subjecting a mixture of a colorant, a resin which can be rendered self-emulsifiable upon neutralization and an organic solvent as essential components to phase inversion emulsification in an aqueous medium in the presence of a neutralizer in an amount large enough to render the resin self-emulsifiable to produce in said aqueous medium a particulate material comprising a colorant encapsulated in a binder resin, and then separating and drying said particulate material, wherein as said resin which can be rendered self-emulsifiable upon neutralization there is used an uncrosslinked styrene-acrylic resin with an acid value of from 30 to 150 containing two or more crosslinkable functional groups per molecule on the average and a crosslinking agent capable of reacting with the crosslinkable functional group in said resin is incorporated in said mixture which is then subjected to crosslinking in an aqueous medium to produce a particulate material comprising a colorant encapsulated in a crosslinked styrene-acrylic resin having a THF-insoluble content of from 0.5 to 70% by weight as a binder resin.

5. The preparation process as described in Clause 4, wherein said uncrosslinked styrene-acrylic resin is one having a molecular weight of from 5,000 to 200,000 in polystyrene equivalence as determined by gel permeation chromatography (GPC).

6. The preparation process as described in Clause 4 or 5, wherein both the crosslinkable functional group in said uncrosslinked styrene-acrylic resin with an acid value of from 30 to 150 containing a crosslinkable functional group and the origin of acid value are carboxyl groups and said crosslinking agent is a compound containing two or more glycidyl groups per molecule on the average.

7. The preparation process as described in Clause 4, 5 or 6, wherein both the crosslinkable functional group in said uncrosslinked styrene-acrylic resin with an acid value of from 30 to 150 containing a crosslinkable functional group and the origin of acid value are carboxyl groups and said crosslinking agent is a tertiary amine compound having a structure represented by the following general formula (1) or (2) containing two to four glycidyl groups per molecule on the average:

(1)

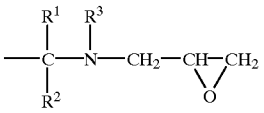

-continued (2)

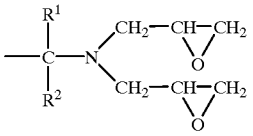

wherein $R^1$ and $R^2$ each represent a substituted or unsubstituted aromatic ring or alicyclic group, hydrogen atom or $C_{1-4}$ alkyl group; and $R^3$ represents a $C_{1-4}$ alkyl group.

8. The preparation process as described in Clause 4, 5, 6 or 7, wherein said uncrosslinked styrene-acrylic resin with an acid value of from 30 to 150 containing a crosslinkable functional group is an uncrosslinked styrene-acrylic resin, obtained by mixing an uncrosslinked styrene-acrylic resin with a weight-average molecular weight (Mw) of from 50,000 to 200,000 containing a crosslinkable functional group and a styrene-acrylic resin with a weight-average molecular weight (Mw) of from 5,000 to less than 50,000 which may contain a crosslinkable functional group.

9. The preparation process as described in Clause 4, 5, 6 or 7, wherein said uncrosslinked styrene-acrylic resin with an acid value of from 30 to 150 containing a crosslinkable functional group is an uncrosslinked styrene-acrylic resin, obtained by mixing an uncrosslinked styrene-acrylic resin with an acid value of from 30 to 150 and a weight-average molecular weight (Mw) of from 50,000 to 200,000 containing a crosslinkable functional group and a styrene-acrylic resin with an acid value of from 30 to 150 and a weight-average molecular weight (Mw) of from 5,000 to less than 50,000 which may contain a crosslinkable functional group.

10. The preparation process as described in Clause 4, 5, 6 or 7, wherein said resin containing a crosslinkable functional group which can be rendered self-emulsifiable upon neutralization is an uncrosslinked styrene-acrylic resin having an acid value of from 30 to 150 mg (KOH)/g obtained by polymerizing one of two or more different mixtures of addition-polymerizable monomers, at least one of said mixtures comprising styrene and/or (meth)acrylic acid ester and the whole of said mixtures comprising styrene and (meth) acrylic acid ester, in a reaction vessel until the conversion reaches a range of from 20% to 80%, and then adding the other to the polymerization system in the same reaction vessel to cause further polymerization.

11. The preparation process as described in Clause 4, 5, 6 or 7, wherein said resin containing a crosslinkable functional group which can be rendered self-emulsifiable upon neutralization is a styrene-acrylic resin having an acid value of from 30 to 150 mg (KOH)/g comprising components having a molecular weight of from 80,000 to 500,000 and from 6,000 to 60,000, respectively, obtained by polymerizing one of two or more different mixtures of addition-polymerizable monomers, at least one of said mixtures comprising styrene and/or (meth)acrylic acid ester and the whole of said mixtures comprising styrene and (meth)acrylic acid ester, in a reaction vessel until the conversion reaches a range of from 20% to 80%, and then adding the other to the polymerization system in the same reaction vessel to cause further polymerization.

12. The preparation process as described in Clause 4, 5, 6 or 7, wherein said resin containing a crosslinkable functional group which can be rendered self-emulsifiable upon neutralization is a styrene-acrylic resin with an acid value of from 30 to 150 mg (KOH)/g having a maximum at two or more different molecular weight values (based on weight) obtained by polymerizing one of two or more mixtures of addition-polymerizable monomers which have been prepared such that at least one of the two or more mixtures contains a styrene and/or (meth)acrylic acid ester, the two or more mixtures contain a styrene and (meth)acrylic acid ester as a whole, and the theoretical glass transition temperature (Tg) of the resin produced when it is assumed that the addition-polymerizable monomers in the mixture to be first polymerized have been reacted in a proportion of 100% is lower than that of the resin produced when it is assumed that the addition-polymerizable monomers in the resin to be subsequently polymerized in the same reaction vessel are reacted in a proportion of 100%, in a reaction vessel until the conversion reaches 20 to 80%, and then adding the other to the polymerization system in the same reaction vessel to cause further polymerization.

13. The preparation process as described in Clause 4, 5, 6, 7, 8, 9, 10, 11 or 12, wherein an aqueous dispersion of a particulate wax having a smaller particle diameter than the particulate toner to be produced is used.

14. An electrophotographic toner having a volume-average particle diameter of from 3 to 15 $\mu$m comprising a spherical particulate material having an average circularity of not less than 0.97 having a colorant encapsulated in a binder resin, wherein said binder resin is a styrene-acrylic resin having an acid value of from 30 to 150 which is at least partly crosslinked and the tetrahydrofuran insoluble content in the whole of the binder resin including crosslinked portions in said particulate material is from 0.5 to 70% by weight.

15. The electrophotographic toner as described in Clause 14, which exhibits an aerated bulk density of not less than 0.35 g/cm$^3$.

16. The electrophotographic toner as described in Clause 14 or 15, which is a particulate material comprising a wax encapsulated in a binder resin with a colorant.

17. The electrophotographic toner as defined in Clause 14, 15 or 16, wherein a metal oxide fine particle subjected to surface treatment with a trifluoromethyl group-containing organic compound is externally added thereto.

18. The electrophotographic toner as described in Clause 17, wherein said metal oxide fine particle is titanium oxide having an average particle diameter of from 5 to 100 nm.

19. The electrophotographic toner as described in Clause 14, 15 or 16, wherein an electrically conductive fine particle and a hydrophobic silica fine particle are externally added thereto.

20. A process for the preparation of an electrophotographic toner having an average circularity of not less than 0.97 and a volume-average particle diameter of from 3 to 15 $\mu$m which comprises subjecting a mixture of a colorant, a resin which can be rendered self-emulsifiable upon neutralization and an organic solvent as essential components to phase inversion emulsification in an aqueous medium in the presence of a neutralizer in an amount large enough to render the resin self-emulsifiable to produce in said aqueous medium a particulate material comprising a colorant encapsulated in a binder resin, and then separating and drying said particulate material, characterized in that as said resin which can be rendered self-emulsifiable upon neutralization there is used an uncrosslinked styrene-acrylic resin with an acid value of from 30 to 150 containing two or more crosslinkable functional groups per molecule on the average and a crosslinking agent capable of reacting with the crosslinkable functional group in said resin is incorporated in said mixture which is then subjected to phase inversion emulsification to produce a spherical particulate material which is then subjected to crosslinking in an aqueous medium to produce a particulate material the binder resin in which is a crosslinked styrene-acrylic resin having a tetrahydrofuran insoluble content of from 0.5 to 70% by weight.

21. The process for the preparation of an electrophotographic toner as described in Clause 20, wherein said uncrosslinked styrene-acrylic resin is a resin having a weight-average molecular weight of from 5,000 to 200,000 in polystyrene equivalence as determined by gel permeation chromatography.

22. The process for the preparation of an electrophotographic toner as described in Clause 20 or 21, wherein both the crosslinkable functional group in said uncrosslinked styrene-acrylic resin with an acid value of from 30 to 150 containing crosslinkable functional groups and the origin of acid value are carboxyl groups and said crosslinking agent is a compound containing not less than 2 glycidyl groups per molecule on the average.

23. The process for the preparation of an electrophotographic toner as described in Clause 20, 21 or 22, wherein both the crosslinkable functional group in said uncrosslinked styrene-acrylic resin with an acid value of from 30 to 150 containing crosslinkable functional groups and the origin of acid value are carboxyl groups and said crosslinking agent is a tertiary amine compound containing from 2 to 4 glycidyl groups having the following structural formula on the average per molecule:

(1)

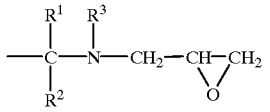

(2)

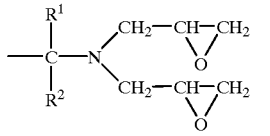

wherein $R^1$ and $R^2$ each represent a substituted or unsubstituted aromatic or alicyclic group, hydrogen atom or $C_{1-4}$ alkyl group; and $R^3$ represents a $C_{1-4}$ alkyl group.

24. The process for the preparation of an electrophotographic toner as described in Clause 20, 21, 22 or 23, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having a weight-average molecular weight of from 50,000 to 200,000 and a styrene-acrylic resin having a weight-average molecular weight of from 5,000 to less than 50,000 which may contain a crosslinkable functional group.

25. The process for the preparation of an electrophotographic toner as described in Clause 20, 21, 22 or 23, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having an acid value of from 30 to 150 and a weight-average molecular weight of from 50,000 to 200,000 and a styrene-acrylic resin having an acid value of from 10 to 150 and a weight-average molecular weight of from 5,000 to less than 50,000 which may contain a crosslinkable functional group.

26. The process for-the preparation of an electrophotographic toner as described in Clause 20, 21, 22 or 23, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having an acid value of from 30 to 150 and a weight-average molecular weight of from 50,000 to 200,000 and a styrene-acrylic resin with an acid value of from 30 to 150 and a weight-average molecular weight of from 5,000 to less than 50,000 which may contain a crosslinkable functional group.

27. The process for the preparation of an electrophotographic toner as described in Clause 20, wherein said resin containing a crosslinkable functional group which can be rendered self-emulsifiable upon neutralization is an uncrosslinked styrene-acrylic resin having an acid value of from 30 to 150 obtained by a process which comprises subjecting one of two or more addition-polymerizable monomer mixtures (containing at least styrene and (meth) acrylic acid ester) to polymerization in a reaction vessel, and then supplying the other mixture into the same reaction vessel where it is then polymerized with the polymerization product.

28. The process for the preparation of an electrophotographic toner as described in Clause 20, 21, 22, 23, 24, 25, 26 or 27, wherein a wax dispersed in an aqueous medium or nonaqueous medium is used.

EXAMPLES

The present invention will be further described in the following examples and comparative examples. The term "parts" and "%" as used hereinafter are by weight.

The materials used in the examples of the present invention and their abbreviations will be described hereinafter.

Abbreviation of polymerizable monomers:

| | |
|---|---|
| ST | Styrene |
| BA | Normal butyl acrylate |
| AA | Acrylic acid |

Abbreviation of solvents:

| | |
|---|---|
| MEK | Methyl ethyl ketone |
| IPA | Isopropyl alcohol |
| THF | Tetrahydrofuran |

Abbreviation of polymerization catalyst:

| | |
|---|---|
| P-0 | "Perbutyl 0" (t-Butyl peroxy (2-ethyl hexanoate), polymerization catalyst available from NOF Corp.) |

Abbreviation of crosslinking agents:

| | |
|---|---|
| TETRAD-X | "TETRAD-X" (glycidylamine available from Mitsubishi Gas Chemical Co., Inc. (N,N,N',N'-tetraglycidyl-metaxylenediamine; epoxy equivalent: 100; average number of glycidyl groups contained per molecule: 4) |
| BZA | N,N-diglycidylbenzylamine (epoxy equivalent: 110; average number of glycidyl groups contained per molecule: 2) |

Carbon black:

All the carbon blacks used as a pigment in the examples of the present invention were "ELFTEX 8" (available from Cabot Corp. of US).

Water:

The water used in phase inversion emulsification, rinsing, etc. in the examples of the present invention was ion-exchanged water. Accordingly, the simple term "water" as used hereinafter is meant to indicate ion-exchanged water.

Wax:

| | |
|---|---|
| H808 | Water-dispersed emulsion of Fischer-Tropsch wax (synthetic wax of higher hydrocarbon available frorn Chukyo Yushi Co., Ltd.)<br>Melting point: 105° C.<br>Dv: 0.5 μm<br>Solid content: 30%<br>Dispersion medium: water<br>Dispersion stabilizer: used |

Synthesis of resin:

In the following examples and comparative examples, four kinds of styrene-acrylic resins were used. In all the four styrene-acrylic resins, both the functional group which adds to its hydrophilicity upon neutralization and the crosslinkable functional group were carboxyl groups. The synthesis and details of these resins will be described hereinafter.

Synthesis Example 1

Into a 3-l flask equipped with a monomer dropping apparatus, a thermometer, a nitrogen gas intake pipe, an agitator and a reflux condenser were charged 430 parts of MEK. To the content of the flask was then added dropwise a mixture of the following monomers and polymerization initiator at a temperature of 80° C. in 3 hours.

| | |
|---|---|
| ST | 633 parts |
| BA | 290 parts |
| AA | 77 parts |
| P-0 | 4 parts |

After 3 hours and 6 hours of the completion of the dropwise addition, 1 part of P-O was added to the system. Further, after 12 hours, 15 hours and 16 hours of the completion of the dropwise addition, 2 parts of P-O were added to the system. Finally, the rest part of P-O was added to the system. The reaction continued at 80° C. for 3 hours before termination. MEK was then added to the system in such an amount that the nonvolatile content of the system was adjusted to 50% to obtain a resin solution (R-1). The resin thus obtained exhibited a glass transition temperature (Tg) of 55° C., a weight-average molecular weight of 80,000 and an acid value of 60.

Synthesis Example 2

Into the flask as used in Synthesis Example 1 were charged 1,000 parts of MEK. To the content of the flask was then added a mixture of the following polymerizable monomers and polymerization initiator at a temperature of 80° C. in 3 hours.

| | |
|---|---|
| ST | 621 parts |
| BA | 302 parts |
| AA | 77 parts |
| P-0 | 30 parts |

After 3 hours and 6 hours of the completion of the dropwise addition, 5 parts of P-O was added to the system. The reaction continued at 80° C. for 3 hours before termination. MEK was then added to the system in such an amount that the nonvolatile content of the system was adjusted to 50% to obtain a resin solution (R-2). The resin thus obtained exhibited a glass transition temperature (Tg) of 52° C., a weight-average molecular weight of 29,000 and an acid value of 60.

Synthesis Example 3

Into the flask as used in Synthesis Example 1 were charged 430 parts of MEK. To the content of the flask was then added a mixture of the following polymerizable monomers and polymerization initiator at a temperature of 80° C. in 3 hours.

| | |
|---|---|
| ST | 662 parts |
| BA | 248 parts |
| AA | 90 parts |
| P-0 | 4 parts |

Then, the catalysts were added to the system as in Synthesis Example 1. MEK was then added to the system in such an amount that the nonvolatile content of the system was adjusted to 50% to obtain a resin solution (R-3). The resin thus obtained exhibited a glass transition temperature (Tg) of 64° C., a weight-average molecular weight of 80,000 and an acid value of 70.

Synthesis Example 4 (In-situ Polymerized Resin)

Into the same reaction vessel as used in Synthesis Example 1 were charged 114 parts of MEK, 12 parts of IPA and 24 parts of ion-exchanged water. The content of the reaction vessel was then heated to a temperature of 80° C. Into the reaction vessel was then charged the following composition 1 at once to initiate polymerization.

Composition 1:

| | |
|---|---|
| ST | 330 parts |
| BA | 216 parts |
| AA | 54 parts |
| P-0 | 0.6 part |

After 3 hours, 10 parts of the reaction resin solution were sampled, diluted with the same amount of MEK, and then measured for viscosity by means of a Gardener viscometer every 1 hour. When the viscosity reached P-Q, a 567/63 (by parts) mixture of MEK and IPA was added to the system. The percent residue of monomer was then determined by gas chromatography. From the results, the conversion at the 1st stage was calculated. The results were 60%.

When the temperature of the system reached 80° C., the following composition 2 was then added dropwise to the system in 1 hour.

Composition 2:

| | |
|---|---|
| ST | 413 parts |
| BA | 133 parts |
| AA | 54 parts |
| P-0 | 18 parts |

After the completion of the dropwise addition, 2 parts of P-O were added to the system three times every 3 hours. The reaction continued for 4 hours before termination. Finally, MEK was added to the system in an amount such that the nonvolatile content reached 50% to obtain a resin solution (R-4). The resin (R-4) had the following properties:

| | |
|---|---|
| *Acid value of resin: | 70 mg (KOH)/g |
| *Acid value of monomer mixture: | Composition 1: 70<br>Composition 2: 70 |
| *Design Tg: | Composition 1: 25° C.<br>Composition 2: 50° C. |
| *Monomer weight ratio: | Composition 1/Composition 2 = 50/50 |
| *Conversion of Composition 1: | 60% |
| *Area ratio on GPC: | Composition 1/Composition 2 = 28/72 |
| *Weight-average molecular weight by composition: | Composition 1: 360,000<br>Composition 2: 35,000 |
| *Weight-average molecular weight: | 124,000 |
| *Tg: | 61° C. |

Description of Resin Properties

| | |
|---|---|
| *Acid value: | mg of KOH required to neutralize 1 g of solid resin content |
| *Design Tg: | Tg determined when it is assumed that the conversion of polymerizable monomer reaches 100% and calculated by Fox's equation (see Phys. Soc., 1[3], 123(1956)) |
| *Molecular weight: | Determined in polystyrene equivalence by gel permeation chromatography (GPC) |

The measurement of molecular weight is effected under the following conditions:

| | |
|---|---|
| Apparatus: | HLC-8020, available from Tosoh Corp. |
| Measurement range of molecular weight: | 500 to 4,000,000 (in polystyrene equivalence) |
| Reference polystyrene: | available from Tosoh Corp. |
| Mobile phase: | THF |
| Flow rate: | 1 ml/min. |
| Concentration of specimen: | Diluted with THF to 0.2% |
| Column: | Tskgel Hxl 5000 + 3000 + 2000 + 1000, available from Tosoh Corp. |
| Column constant temperature bath: | 40° C. |
| Detector: | RI |
| *Area ratio on GPC: | Area ratio of peaks separated at the bottom on measured chart |
| *Weight-average molecular weight by composition: | Weight-average molecular weight within the separated range |
| *Weight-average molecular weight: | Value averaged over the entire resin |
| *Tg: | Measured by differential scanning calorimetry (DSC) |
| Apparatus: | DSC-50, available from Shimadzu Corp. |
| Gas: | Helium (flow rate: 30 ml/min.) |
| Rate of temperature increase: | 10° C./min. |

Description of Process for the Preparation of Toner by Phase Inversion Emulsification Comparative Example 1

900 parts of the resin solution R-1 and 50 parts of carbon black were kneaded by means of Type M-250 Eiger Motor Mill (motor mill available from Eiger Japan K.K.) for 1 hour. MEK was then added to the material in an amount such that the nonvolatile content thereof was adjusted to 50% to prepare a mill base. The ratio of solid resin content to pigment in the mill base thus obtained was 90/10.

Subsequently, to 200 parts of the mill base were added 12.5 parts of a 1N aqueous solution of sodium hydroxide as a neutralizer and 24 parts of IPA. To the mixture was then added dropwise 80 cc of water with stirring over 10 minutes to cause phase inversion emulsification. To the mixture were then added 600 parts of water. The mixture was then subjected to the following after-treatment steps to prepare a non-crosslinked particulate toner of Comparative Example 1.

When the 1N aqueous solution of sodium hydroxide are used in an amount of 12.5 parts, 13% of the carboxyl groups contained in the resin in the mill base can be neutralized. Such a percent will be hereinafter referred to as "degree of neutralization".

After-treatment (1) The mixture is subjected to distillation under reduced pressure to remove the organic solvent therefrom.

(2) The mixture is withdrawn by filtration.

(3) To the resulting cake are then added 500 parts of water. To the mixture is then added a 1N aqueous solution of hydrochloric acid with stirring to adjust the pH value thereof to a range of 2 to 3.

(4) The material is withdrawn by filtration, and then washed with 500 parts of water.

(5) The hydrous cake thus obtained is freeze-dried.

In the phase inversion emulsification in the examples and comparative examples described hereinafter, the dispersion of a pigment was accomplished by kneading the material by means of the foregoing motor mill for 1 hour. The ratio of solid resin content to pigment in the mill base were 90/10.

Example 1

450 parts of the resin solution (R-1), 450 parts of the resin solution (R-2) and 50 parts of carbon black were processed in the same manner as in Comparative Example 1 to prepare a mill base having a nonvolatile content of 50%.

200 parts of the mill base, 24 parts of IPA, 12.5 parts (degree of neutralization: 13%) of a 1N aqueous solution of sodium hydroxide and 0.27 part of "TETRAD-X" as a crosslinking agent were mixed. To the mixture was then gradually added dropwise 80 cc of water with stirring over 10 minutes to cause phase inversion emulsification. To the mixture were then added 600 parts of toner. The mixture was then subjected to the following after-treatment to prepare a crosslinked particulate toner of Example 1.

After-treatment in the Case where Crosslinking Occurs (1) The mixture is subjected to distillation under reduced pressure to remove the organic solvent therefrom.

(2) To the material is then added 400 cc of water. The material is then allowed to undergo crosslinking reaction at 60° C. for 8 hours.

(3) The mixture is withdrawn by filtration.

(4) To the resulting cake are then added 500 parts of water. To the mixture is then added a 1N aqueous solution of hydrochloric acid with stirring to adjust the pH value thereof to a range of 2 to 3.

(5) The material is withdrawn by filtration, and then washed with 500 parts of water.

(6) The hydrous cake thus obtained is freeze-dried.

In this manner, 0.27 part of "TETRAD-X" correspond to 0.3 part by weight based on 100 parts by weight of the solid resin content. The content of glycidyl group was about 0.028 mol per mol of carboxyl group.

Example 2

The procedure of Example 1 was followed except that the phase inversion emulsification was effected in the presence of 0.45 part of "TETRAD-X" as a crosslinking agent. Thus, a crosslinked particulate toner of Example 2 was prepared. 0.45 part of "TETRAD-X" correspond to 0.5 part by weight based on 100 parts by weight of the solid resin content. The content of glycidyl group was about 0.047 mol per mol of carboxyl group.

Example 3

The procedure of Example 1 was followed except that the phase inversion emulsification was effected in the presence of 0.9 part of BZA as a crosslinking agent. Thus, a crosslinked particulate toner of Example 3 was prepared. 0.9 part of BZA correspond to 1.0 part by weight based on 100 parts by weight of the solid resin content. The content of glycidyl group was about 0.085 mol per mol of carboxyl group.

Comparative Example 2

900 parts of the resin solution (R-3) and 50 parts of carbon black were processed in the same manner as in Comparative Example 1 to prepare a mill base having a nonvolatile content of 50%.

200 parts of the mill base thus prepared were then mixed with 24 parts of IPA and 13.5 parts of a 1N aqueous solution of sodium hydroxide (degree of neutralization: 12%). The reaction mixture was then subjected to phase inversion emulsification and after-treatment in the same manner as in Comparative Example 1 to prepare an uncrosslinked particulate toner of Comparative Example 2.

Example 4

200 parts of the mill base prepared in Comparative Example 2, 24 parts of IPA, 13.5 parts of a 1N aqueous solution of sodium hydroxide, and 0.27 part of "TETRAD-X" as a crosslinking agent were mixed. The reaction mixture was then subjected to phase inversion emulsification, crosslinking, and after-treatment in the same manner as in Example 1 to prepare a crosslinked particulate toner of Example 4.

0.27 part of "TETRAD-X" correspond to 0.3 part by weight based on 100 parts by weight of the solid resin content. The content of glycidyl group was about 0.02 mol per mol of carboxyl group.

Example 5

The procedure of Synthesis Example 1 was followed except that 900 parts of the resin solution (R-4) and 50 parts of carbon black were used. Thus, a mill base having a nonvolatile content of 51% was prepared.

Subsequently, to 300 parts of the mill base were added 20.7 parts (degree of neutralization: 12%) of a 1N aqueous solution of sodium hydroxide, 34 parts of IPA, 30 parts of MEK, 0.09 part of "TETRAD-X" and 90 parts of water. The mixture was then thoroughly stirred. The internal temperature of the mixture was then kept to 30° C. Under these conditions, to the mixture was then added dropwise water at a rate of 5 ml/min. over 6 minutes with stirring to cause phase inversion emulsification. After 30 minutes, to the mixture were added 300 parts of water.

The material was then subjected to crosslinking and after-treatment in the same manner as in Example 1 to prepare a crosslinked particulate toner of Example 5.

0.09 part of "TETRAD-X" correspond to 0.065 part by weight based on 100 parts by weight of the solid resin content. The content of glycidyl group was about 0.005 mol per mol of carboxyl group.

Example 6

900 parts of the resin solution (R-4) and 50 parts of carbon black were kneaded for 1 hour by means of the foregoing motor mill. To the mixture thus kneaded were then added 40.5 parts (12.15 parts as calculated in terms of solid content) of an emulsion of particulate wax "H808". The mixture was then subjected to stirring and dispersion over 10 minutes by means of the foregoing motor mill. The non-volatile content of the mixture was then adjusted to 51% to prepare a mill base. The ratio of solid resin content to solid wax content in the mill base was 100/2.7.

The purpose of dispersing the mixture which has comprised a wax incorporated therein by means of a motor mill is not to provide a finer particulate material but to loosen the particulate wax which has been partly agglomerated when added to the mixture.

Subsequently, to 300 parts of the mill base were added 20.7 parts of a 1N aqueous solution of sodium hydroxide, 34 parts of IPA, 30 parts of MEK, 0.09 part of "TETRAD-X" and 90 parts of water. The mixture was then thoroughly stirred. The mixture was then subjected to phase inversion emulsification, crosslinking and after-treatment in the same manner as in Example 4 to prepare a crosslinked particulate toner having a wax encapsulated therein of Example 6.

Physical Properties of Particulate Toner Prepared in Examples and Comparative Examples The particulate toner of Example 6 comprising a wax encapsulated therein was embedded in a resin. The embedded particulate toner was then sliced by a microtome. The slice was dyed with ruthenium tetraoxide, and then observed under TEM (transmission electron microscope). As a result, a pigment and a wax were found encapsulated in the particulate toner. All the particulate toners obtained in Comparative Example 1 and Examples 1 to 6 exhibited an average circularity of from 0.98 to 0.99 and thus were substantially spherical. All the particulate toners thus obtained exhibited a Wadell's operational sphericity of not less than 0.8, actually not less than 0.95, and thus were substantially spherical.

Volume-average particle diameter

The particulate toners of Comparative Example 1 and Examples 1, 2 and 3 had a volume-average particle diameter of from 6.0 to 9.0 μm. The particulate toner of Comparative Example 2 had a volume-average particle diameter of 7.5 μm. The particulate toner of Example 4 had a volume-average particle diameter of 8.3 μm. The particulate toner of Example 5 had a volume-average particle diameter of 7.8 μm. The particulate toner of Example 6 had a volume-average particle diameter of 7.6 μm.

Average circularity: All the particulate toners of the foregoing examples exhibited an average circularity of not less than 0.98.

Method and Criterion of Evaluation of Toners

To each of the particulate toners thus obtained was added "R-972" (particulate silica available from Nippon Aerosil Co., Ltd.) in an amount of 0.5% (0.3%, in Comparative Example 2 and Example 4). The specimen was then evaluated for fixability, bulk density and storage stability. For the evaluation of other properties, the dried powder toner was used as it was.

Toner Fixability Test

A blend of 22.5 parts of the foregoing toner having a particulate silica externally added thereto and 427.5 parts of a commercial ferrite carrier was used. The blend thus obtained was then used to print an image on paper in such a manner that ID value reached not less than 1.5. The term "ID value" as used herein is meant to indicate an image density determined by means of a Type Macbeth RD-918 printing reflection densitometer available from Macbeth Corp. of USA.

For the image printing and fixability test, an oilless type copying machine available from Ricoh Co., Ltd. (Imagio DA250) which was disassembled into an image printing zone and a fixing zone which were then remodelled was used, but in Comparative Example 2 and Example 4, a copying machine available from Mita Industrial Co., Ltd. (Mita Copia DC-111) which was disassembled into an image printing zone and a fixing zone which were then remodelled was used. (Criterion of evaluation of fixability)

Fixing starting temperature: A paper on which an image had been printed was passed at a rate of 130 mm/sec. over a heated roll (silicone oil-free type) the surface temperature of which had been properly controlled so that the image was fixed. A membrane tape was-then stuck to the image thus hot-fixed. A load of 100 g/cm$^2$ was then placed on the laminate. The cellophane tape was then peeled off the material. ID value of the image was then measured. The fixing starting temperature is represented by the surface temperature of the heated roll at which ID value of the image determined after the membrane tape peeling test reaches not less than 90% of that before the test.

Anti-hot offset temperature: A paper on which an image had been printed was passed at a rate of 130 mm/sec. over a heated roll (silicone oil-free type) the surface temperature of which had been properly controlled. The temperature at which hot offset occurs is the hot offset generating temperature. The anti-hot offset temperature is represented by the temperature at which hot offset is about to occur.

Fixing temperature range: Temperature range within which fixing can be effected between the fixing starting temperature and the anti-hot offset temperature Anti-curling property: A paper on which an image had been printed was passed at a rate of 130 mm/sec. over a heated roll (silicone oil-free type) the surface temperature of which had been properly controlled. During this process, the curling of the paper to the heated roll was observed. This phenomenon was evaluated in accordance with the following 3-step criterion:

○: No curling

Δ: Paper warps

X: Paper wound on the heated roll

The evaluation of fixability was effected every 5° C. up to 220° C. Further, in Comparative Example 2 and Example 4, it was effected every 5° C. up to 245° C., since the heat fixing roll of Mita Copia DC-111 has higher heat-resisting temperature.

Storage stability: For the evaluation of storage stability, 5 g of the silica-added toner was allowed to stand at a temperature of 50° C. in a 50 cc glass sample bottle for 7 days. The temperature of the sample was then returned to room temperature. The sample bottle was then inverted. The samples in which the content had dropped through inside the bottle within 10 seconds were considered acceptable.

Criterion of evaluation of processability to phase inversion emulsification

The problem confronted when the phase inversion emulsification occurs is whether or not the form of the particulate material is good. A particulate material in a good form looks spherical and deep-black when observed under an optical microscope. On the contrary, a particulate material in a bad form has agglomerated carbon and looks unevenly transparent inside or on particles when observed under an optical microscope. Such a bad form exhibits a smaller bulk density than normal form. Further, such a bad form is disadvantageous in that it provides a toner having a deteriorated durability. All the toners of the foregoing examples where external addition was conducted exhibited a bulk density of not less than 0.40 g/cm$^3$.

Further, the bulk density (g/cm$^3$; having the same meaning as the aerated bulk density; when toners placed in a sieve were fallen into a standing vessel while vibrating to fill the vessel, a numeral obtained by dividing the toner weight in the vessel by the inner volume of the vessel)) is also shown. The bulk density (aerated bulk density) was measured after externally adding 0.5% of R972. The bulk density measured before the addition of R972 was from 0.25 to less than 0.35 for any primary body toner of Examples.

As in the examples of the present invention, the black toner using a styrene-acrylic resin can be judged for processability to phase inversion emulsification by bulk density. The toner which exhibits a bulk density of not less than 0.35 is regarded as acceptable. On the contrary, the toner which exhibits a bulk density of less than 0.35 is not desirable.

THF-insoluble Content

The specimen was subjected to Soxhlet extraction with THF for 24 hours. The dried weight of the extract was measured. The insoluble content per unit weight of resin was calculated.

Measurement Method

Pigments such as carbon or ash content were contained in the toner. Accordingly, the insoluble content in the resin component was calculated as follows. This method can be employed when a styrene-acrylic resin is used and the pigment is carbon.

For the measurement and calculation of the resin content in the toner, the resin is thermally decomposed by thermogravimetry. The measurement conditions will be described later.

The particulate toner is subjected to Soxhlet extraction with THF.

The extract is concentrated, dried, and then measured for dried weight.

The foregoing dried specimen is subjected to thermogravimetry to calculate the resin content.

Calculation $$\% \text{ Insoluble resin content in toner} = (w1 - w2) \times 100 / w1$$

where w1 is the resin content in the toner before Soxhlet extraction, and w2 is the resin content in Soxhlet extract Measurement by thermogravimetry Apparatus: "TG-30", available from Shimadzu Corp.

The specimen is heated at a rate of 30° C./min. to 500° C. in a stream of nitrogen gas at a flow rate of 5 ml/min. When the specimen shows weight drop any longer at 500° C., the measurement is terminated. The weight drop determined at this point is the resin content. The residue contains carbon and ash content.

When the colorant is an organic pigment, thermogravimetry is not sufficient for analysis. Fluorescent X-ray analysis or the like can be employed to determine the content of pigment. The combined use of thermogravimetry and fluorescent X-ray analysis makes it possible to determine the ash content and pigment content. As a result, the resin content can be determined.

Molecular Weight

The toner component soluble in THF was measured by GPC. The measurement conditions were the same as in the resin. The molecular weight of THF-soluble content in the crosslinked toner of the present invention was higher than that of the resin used in all the examples, demonstrating that the crosslinking reaction with the crosslinking agent had occurred.

Volume-average Particle Diameter Dv

For the measurement of volume-average particle diameter (μm), "COUNTER MULTISIZER 2", available from K.K. Nikkaki, was used.

Tg

The glass transition temperature of the specimen was measured by DSC under the same conditions as in the resin.

Acid Value

The acid value of THF-soluble component in all the crosslinked toners of the examples was from 5 lower than that of the resin used to 5 greater than that of the resin used.

TABLE 1

| | Comparative Example 1 | Example 1 | Example 2 | Example 3 |
|---|---|---|---|---|
| Composition/ crosslinking | | | | |
| Resin | R-1 | R-1/R-2 = 50/50 | R-1/R-2 = 50/50 | R-1/R-2 = 50/50 |
| Cross-linking agent | | | | |
| Kind | None | TETRAD-X | TETRAD-X | BZA |
| Amount | — | 0.3 | 0.5 | 1.0 |
| Ratio | — | 0.028 | 0.047 | 0.085 |
| Particulate material | | | | |
| Tg (° C.) | 56 | 54 | 54 | 53 |
| Insoluble content (%) | 0 | 21 | 30 | 28 |
| Fixability | | | | |
| Fixing starting temp. (° C.) | 135 | 115 | 120 | 120 |
| Anti-hot offset (° C.) | 160 | 210 | >220 | >220 |
| Fixing temp. range (° C.) | 25 | 95 | >100 | >100 |

All the particulate toners of examples and comparative example set forth in Table 1 had Dv of from 6.0 to 9.0 and an average circularity of from 0.98 to 0.99.

TABLE 2

| | Comparative Example 2 | Example 4 |
|---|---|---|
| Composition/cross-linking | | |
| Resin | R-3 | R-3 |
| Crosslinking agent | | |
| Kind | None | TETRAD-X |
| Amount | — | 0.3 |
| Ratio | — | 0.02 |
| Particulate material | | |
| Dv (μm) | 7.5 | 8.3 |
| Tg (° C.) | 64 | 64 |
| Insoluble content (%) | 0 | 36 |
| Fixability | | |
| Fixing starting temp. (° C.) | 135 | 135 |
| Anti-hot offset (° C.) | 180 | 240 |
| Fixing temp. range (° C.) | 45 | 105 |

Both the particulate toners of Comparative Example 2 and Example 4 set forth in Table 2 exhibited an average circularity of from 0.98 to 0.99.

TABLE 3

| | Example 5 | Example 6 |
|---|---|---|
| Composition/cross-linking | | |
| Resin | R-4 | R-4 |
| Wax | — | 2.7 |
| Crosslinking agent | | |
| Kind | TETRAD-X | TETRAD-X |
| Amount | 0.065 | 0.065 |
| Ratio | 0.005 | 0.005 |
| Particulate material | | |
| Apparent density | | |
| Dv (μm) | 0.413 | 0.407 |
| Tg (° C.) | 7.8 | 7.6 |
| Insoluble | 61 | 61 |
| content (%) | 10 | 11 |
| Fixability | | |
| Fixing starting temp. (° C.) | 120 | 120 |
| Anti-hot offset (° C.) | >220 | >220 |
| Fixing temp. range (° C.) | >100 | >100 |
| Anti-curling property | Δ | ○ |
| Storage stability | Acceptable | Acceptable |

Both the particulate toners of Examples 5 and 6 set forth in Table 3 exhibited an average circularity of from 0.98 to 0.99. In the table, the apparent density has the same meaning as aerated apparent density (bulk density).

The composition in Tables 1, 2 and 3 are as follows.

Amount of crosslinking agent: Amount of crosslinking agent used based on 100 parts of the solid resin content Ratio of crosslinking agent: Ratio of glycidyl group in crosslinking agent used based on 1 mol of carboxyl group Amount of wax: Amount of wax used based on 100 parts of the solid resin content The particulate toners of Examples 1 to 6 and Comparative Examples 1 and 2 were observed on the section under TEM. As a result, all the particulate toners were found to have a particulate pigment dispersed uniformly therein in encapsulated form and little voids present therein. These particulate toners exhibited an aerated bulk density of not less than 0.40 and hence an excellent powder fluidity.

The particulate toners of Examples 1, 2, 3 and 5 exhibited a fixing starting temperature as excellent as about 120° C. In Examples 1 to 5, crosslinking provided a remarkable enhancement of anti-hot offset properties as compared with the comparative examples. In other words, the particulate toners of Examples 1 to 5 can be fixed within a wide range of temperature and thus exhibit a remarkably improved heated roll fixability. Further, the particulate toner of Example 6, which comprises a wax incorporated therein, exhibits an improved anti-curling property.

Examples of external addition according to the present invention will be described hereinafter.

Example 7

5 parts of trifluoropropyltrimethoxysilane $CF_3$—$C_2H_4$—$Si(OCH_3)_3$ were dissolved in 200 parts of methanol. To the solution thus obtained were then added 50 parts of titanium oxide MT-150 having an average primary particle diameter of about 15 nm (produced by TAYCA CORP.). The mixture was then stirred so that it underwent sufficient dispersion. Methanol was then distilled off. The residue was subjected to heat treatment at a temperature of about 120° C., and then crushed to prepare a particulate titanium oxide surface-treated with a trifluoromethyl group-containing organic compound.

To 100 parts of the untreated spherical particulate toner produced in Example 6 were then externally added 1 part of the foregoing particulate titanium oxide and 0.3 part of hydrophobic silica AEROSIL R972 (produced by Nippon Aerosil Co., Ltd.) by means of a Henschel mixer to prepare a toner.

<Measurement of environmental stability>

3 parts of the toner and 97 parts of a silicon resin-coated ferrite carrier having an average particle diameter of 80 μm (produced by Powdertech Co., Ltd.) were exposed to HH (high temperature and humidity conditions: 35° C.—85%) and LL (low temperature and humidity conditions: 10° C.—15%) for about 12 hours, each mixed with each other by means of a ball mill for 30 minutes, and then measured for electrostatic charge by blow-off method (using an electrostatic meter produced by Toshiba Chemical Corp.). The ratio of (electrostatic charge at HH)/(electrostatic charge at LL) was determined as an index of environmental stability.

<Measurement of rising of charging>

3 parts of the toner and 97 parts of the foregoing silicon resin-coated ferrite carrier were mixed by means of a ball mill for 1 minute and for 30 minutes. The mixtures obtained by 1 minute mixing and 30 minute mixing were then measured for electrostatic charging by blow-off method (using an electrostatic meter produced by Toshiba Chemical Corp.).

<Measurement of uniformity in electrostatic charge distribution>

Using a Type E-SPART analyzer (produced by HOSOKAWA MICRON CORP.), the foregoing developer was measured for reverse percent charging.

TABLE 4

| Example No. | Blow-off charge (μC/g) 1 min. mixing | Blow-off charge (μC/g) 30 min. mixing | Reverse percent charging (percent of number) 1 min. mixing | Reverse percent charging (percent of number) 30 min. mixing | Environmental stability HH/LL |
|---|---|---|---|---|---|
| Example 7 | −39.1 | −39.8 | 3.7 | 2.6 | 0.83 |
| Example 6 | −26.5 | −32.0 | 16.2 | 13.0 | 0.44 |

The particulate toner of Example 7 comprising a particulate titanium oxide surface-treated with a trifluoromethyl group-containing organic compound externally added thereto exhibits a drastically improved environmental stability and a very good rising of charging and uniformity of charging as compared with the particulate toner of Example 6 comprising silica alone externally added thereto.

The particulate toner of Example 7 was then subjected to imaging test using a Type Imagio MF530 two-component development process copying machine (produced by Ricoh Co., Ltd.) and a Type 4019 nonmagnetic one-component development process laser printer (produced by IBM). As a result, images having an excellent quality were obtained at an image density of from 1.5 to 1.6.

Example 8

To 100 parts of the untreated spherical particulate toner (before externally added) of Example 6 were added 0.3 part of an electrically-conductive titanium oxide EC-300 (produced by Titan Kogyo K.K.) and 0.5 part of hydrophobic silica AEROSIL R972 (produced by Nippon Aerosil Co., Ltd.) by means of a Henschel mixer to prepare a toner.

TABLE 5

| | Blow-off charge (μC/g) 1 min. mixing | Blow-off charge (μC/g) 30 min. mixing | Reverse percent charging (percent of number) 1 min. mixing | Reverse percent charging (percent of number) 30 min. mixing | Environmental stability HH/LL |
|---|---|---|---|---|---|
| Example 8 | −28.5 | −29.1 | 2.4 | 1.9 | 0.53 |

The toner of Example 8 was measured for triboelectricity in the same manner as mentioned above. The results are set forth in Table 5.

The toner comprising both a particulate electrically-conductive material and a particulate silica externally added exhibits drastically improved rising of charging and uniformity of charging as-compared with the toner of Example 6 comprising a particulate silica alone externally added thereto and the toner comprising a particulate electrically-conductive material alone externally added thereto.

In the imaging test using the same copying machine as mentioned above, the toner of Example 8 gave an image having a good quality free of fog at an image density of from 1.5 to 1.6. On the contrary, the toner comprising a particulate electrically-conductive material alone externally added thereto gave an image having a lower image density with much fog.

In the imaging test using the same printer as mentioned above, the toner of Example 8 gave an image having a good quality free of fog at an image density of from 1.5 to 1.6. On the contrary, the toner comprising a particulate electrically-conductive material alone externally added thereto gave an image having an image density as very low as 1.0 with much fog.

Effect of the Invention

The present invention provides an electrophotographic toner suitable for either two-component development or one-component development having the following properties in combination. In other words, (1) since the styrene-acrylic resin as a binder resin is partly crosslinked, the resulting toner exhibits an excellent heated roll fixability; (2) since the binder resin exhibits a high acid value, the resulting toner exhibits a good triboelectricity even free of CCA; and (3) the resulting toner is composed of spherical particulate material and thus exhibits an excellent fluidity. The external addition of a particulate metal oxide of the present invention provides remarkable improvement in environmental stability and rising of charging.

What is claimed is:

1. An electrophotographic toner having a volume-average particle diameter of from 3 to 15 μm comprising a spherical particulate material having an average circularity of not less than 0.97 having a colorant encapsulated in a binder resin, wherein said binder resin is a styrene-acrylic resin having an acid value of from 30 to 150 which is at least partly crosslinked and the tetrahydrofuran insoluble content in the whole of the binder resin including crosslinked portions in said particulate material is from 0.5 to 70% by weight.

2. The electrophotographic toner as described in claim 1, which exhibits an aerated bulk density of not less than 0.35 g/cm$^3$.

3. The electrophotographic toner as described in claim 1, which is a particulate material comprising a wax encapsulated in a binder resin with a colorant.

4. The electrophotographic toner as defined in claim 1, wherein a metal oxide fine particle subjected to surface treatment with a trifluoromethyl group-containing organic compound is externally added thereto.

5. The electrophotographic toner as described in claim 4, wherein said metal oxide fine particle is titanium oxide having an average particle diameter of from 5 to 100 nm.

6. The electrophotographic toner as described in claim 1, wherein an electrically conductive fine particle and a hydrophobic silica fine particle are externally added thereto.

7. A process for the preparation of an electrophotographic toner having an average circularity of not less than 0.97 and a volume-average particle diameter of from 3 to 15 μm which comprises subjecting a mixture of a colorant, a resin which can be rendered self-emulsifiable upon neutralization and an organic solvent as essential components to phase inversion emulsification in an aqueous medium in the presence of a neutralizer in an amount large enough to render the resin self-emulsifiable to produce in said aqueous medium a particulate material comprising a colorant encapsulated in a binder resin, and then separating and drying said particulate material, characterized in that as said resin which can be rendered self-emulsifiable upon neutralization there is used an uncrosslinked styrene-acrylic resin with an acid value of from 30 to 150 containing two or more crosslinkable functional groups per molecule on the average and a crosslinking agent capable of reacting with the crosslinkable functional group in said resin is incorporated in said mixture which is then subjected to phase inversion emulsification to produce a spherical particulate material which is then subjected to crosslinking in an aqueous medium to produce a particulate material the binder resin in which is a crosslinked styrene-acrylic resin having a tetrahydrofuran insoluble content of from 0.5 to 70% by weight.

8. The process for the preparation of an electrophotographic toner as described in claim 7, wherein said uncrosslinked styrene-acrylic resin is a resin having a weight-average molecular weight of from 5,000 to 200,000 in polystyrene equivalence as determined by gel permeation chromatography.

9. The process for the preparation of an electrophotographic toner as described in claim 7, wherein both the crosslinkable functional group in said uncrosslinked styrene-acrylic resin with an acid value of from 30 to 150 containing crosslinkable functional groups and the origin of acid value are carboxyl groups and said crosslinking agent is a compound containing not less than 2 glycidyl groups per molecule on the average.

10. The process for the preparation of an electrophotographic toner as described in claim 7, wherein both the crosslinkable functional group in said uncrosslinked styrene-acrylic resin with an acid value of from 30 to 150 containing crosslinkable functional groups and the origin of acid value are carboxyl groups and said crosslinking agent is a tertiary amine compound containing from 2 to 4 glycidyl groups having the following structural formula on the average per molecule:

(1)

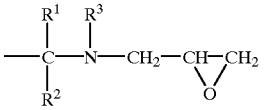

(2)

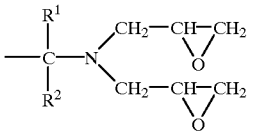

wherein $R^1$ and $R^2$ each represent a substituted or unsubstituted aromatic or alicyclic group, hydrogen atom or $C_{1-4}$ alkyl group; and $R^3$ represents a $C_{1-4}$ alkyl group.

11. The process for the preparation of an electrophotographic toner as described in claim 7, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having a weight-average molecular weight of from 50,000 to 200,000 and a styrene-acrylic resin having a weight-average molecular weight of from 5,000 to less than 50,000 which may contain a crosslinkable functional group.

12. The process for the preparation of an electrophotographic toner as described in claim 7, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having an acid value of from 30 to 150 and a weight-average molecular weight of from 50,000 to 200,000 and a styrene-acrylic resin having an acid value of from 10 to 150 and a weight-average molecular weight of from 5,000 to less than 50,000 which may contain a crosslinkable functional group.

13. The process for the preparation of an electrophotographic toner as described in claim 7, wherein said uncrosslinked styrene-acrylic resin with an acid value of from 30 to 150 containing crosslinkable functional groups is a resin obtained by mixing an uncrosslinked styrene-acrylic resin containing a crosslinkable functional group having an acid value of from 30 to 150 and a weight-average molecular weight of from 50,000 to 200,000 and a styrene-acrylic resin with an acid value of from 30 to 150 and a weight-average molecular weight of from 5,000 to less than 50,000 which may contain a crosslinkable functional group.

14. The process for the preparation of an electrophotographic toner as described in claim 7, wherein said resin containing a crosslinkable functional group which can be rendered self-emulsifiable upon neutralization is an uncrosslinked styrene-acrylic resin having an acid value of from 30 to 150 obtained by a process which comprises subjecting one of two or more addition-polymerizable monomer mixtures (containing at least styrene and (meth) acrylic acid ester) to polymerization in a reaction vessel, and then supplying the other mixture into the same reaction vessel where it is then polymerized with the polymerization product.

15. The process for the preparation of an electrophotographic toner as described in claim 7, wherein a wax dispersed in an aqueous medium or nonaqueous medium is used.

* * * * *